US008350836B2

(12) United States Patent
Nose et al.

(10) Patent No.: US 8,350,836 B2
(45) Date of Patent: Jan. 8, 2013

(54) LIQUID CRYSTAL DISPLAY DEVICE AND LIQUID CRYSTAL DRIVING METHOD

(75) Inventors: Masaki Nose, Kawasaki (JP); Hirokata Uehara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 156 days.

(21) Appl. No.: 13/020,186

(22) Filed: Feb. 3, 2011

(65) Prior Publication Data

US 2011/0210953 A1 Sep. 1, 2011

(30) Foreign Application Priority Data

Feb. 26, 2010 (JP) ..... 2010-043249
Jun. 24, 2010 (JP) ..... 2010-144148

(51) Int. Cl.
*G09G 3/36* (2006.01)

(52) U.S. Cl. ..... 345/208; 349/179

(58) Field of Classification Search ..... 345/87, 345/94, 98–100, 208, 211–212; 349/100, 349/179, 185

See application file for complete search history.

(56) References Cited

U.S. PATENT DOCUMENTS 7,804,472 B2 * 9/2010 Okada et al. ..... 345/94
8,232,952 B2 * 7/2012 Yoshihara et al. ..... 345/100
2008/0024412 A1 1/2008 Nose

FOREIGN PATENT DOCUMENTS

EP 0 957 394 A1 11/1999
JP 11-326871 11/1999
WO WO 2006/103738 A1 10/2006

* cited by examiner

*Primary Examiner* — Abbas Abdulselam
(74) *Attorney, Agent, or Firm* — Kratz, Quintos & Hanson, LLP

(57) ABSTRACT

A liquid crystal display device includes a segment driver, a common driver, and a voltage setting unit. The voltage setting unit derives a voltage at which a previous drive line becomes a focal conic state regardless of image data by applying a synthesized voltage of a voltage that is applied from the segment driver and a voltage that is applied from the common driver to the previous drive line. Then, the voltage setting unit sets the voltages that are applied from the segment driver and the common driver on the basis of the derived result.

10 Claims, 29 Drawing Sheets

| DATA (3 BITS/PIXEL) | | | FORCED SIGNAL | OUTPUT VOLTAGE |
|---|---|---|---|---|
| 0 | 0 | 0 | 1 | V1 |
| 0 | 0 | 1 | | V2 |
| 0 | 1 | 0 | | V3 |
| 0 | 1 | 1 | | V4 |
| 1 | 0 | 0 | | V5 |
| 1 | 0 | 1 | | V6 |
| 1 | 1 | 0 | | V7 |
| 1 | 1 | 1 | | V8 |
| × | × | × | 0 | GND |

FIG.17
| | | | | | SEGMENT DRIVER | | | | | | | |
|---|---|---|---|---|---|---|---|---|---|---|---|---|
| | | | | →→→ | PLANAR | | | | FOCAL CONIC | | | |
| COMMON DRIVER | PREVIOUS DRIVE LINE | | | | -17 | 17 | 17 | -17 | -5 | 5 | 5 | -5 |
| | 3 | -3 | 25 | -25 | 20 | -20 | 8 | -8 | 8 | -8 | 20 | -20 |
| | DRAWING LINE | | | | | | | | | | | |
| | 25 | -25 | -25 | 25 | 42 | -42 | -42 | 42 | 30 | -30 | -30 | 30 |
| | NON-SELECTION LINE | | | | | | | | | | | |
| | -11 | 11 | 11 | -11 | 6 | -6 | -6 | 6 | -6 | 6 | 6 | -6 |
| | | | | | 1.5 | 1.5 | 1.5 | 1.5 | 1.5 | 1.5 | 1.5 | 1.5 |
FIG.18
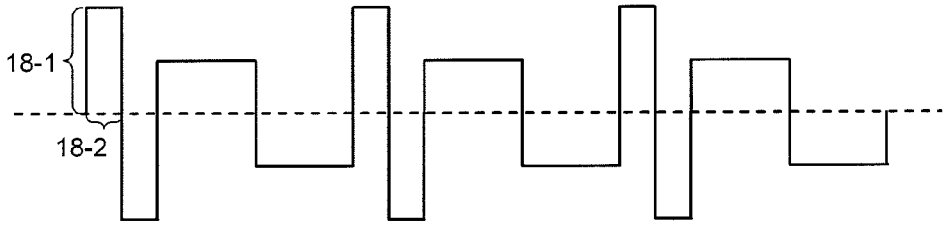
FIG.19
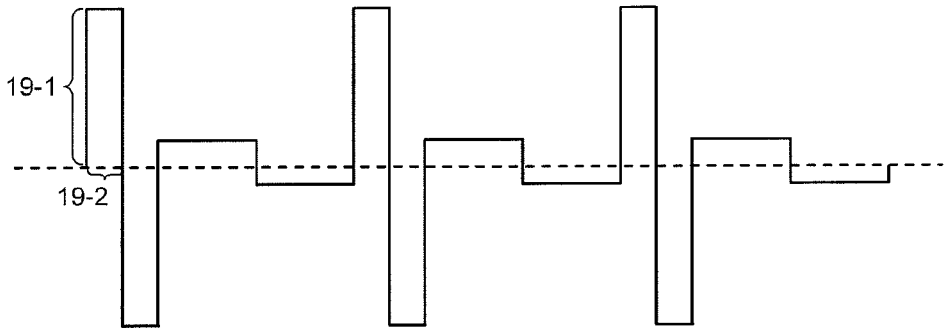

| | | | | | SEGMENT DRIVER | | | | | | | |
|---|---|---|---|---|---|---|---|---|---|---|---|---|
| | | | | →→→ | PLANAR | | | | FOCAL CONIC | | | |
| COMMON DRIVER | PREVIOUS DRIVE LINE | | | | -19 | 19 | 19 | -19 | -7 | 7 | 7 | -7 |
| | 13 | -13 | 23 | -23 | **32** | **-32** | **4** | **-4** | **20** | **-20** | **16** | **-16** |
| | DRAWING LINE | | | | | | | | | | | |
| | 23 | -23 | -23 | 23 | **42** | **-42** | **-42** | **42** | **30** | **-30** | **-30** | **30** |
| | NON-SELECTION LINE | | | | | | | | | | | |
| | -13 | 13 | 13 | -13 | **6** | **-6** | **-6** | **6** | **-6** | **6** | **6** | **-6** |
| | | | | | 0.45 | 0.45 | 2.55 | 0.45 | 0.45 | 0.45 | 2.55 | 2.55 |

| | | | | | SEGMENT DRIVER | | | | | | | |
|---|---|---|---|---|---|---|---|---|---|---|---|---|
| | | | | →→→ | PLANAR | | | | FOCAL CONIC | | | |
| COMMON DRIVER | PREVIOUS DRIVE LINE | | | | -19 | 19 | 19 | -19 | -7 | 7 | 7 | -7 |
| | 0 | 0 | 23 | -23 | **19** | **-19** | **4** | **-4** | **7** | **-7** | **16** | **-16** |
| | DRAWING LINE | | | | | | | | | | | |
| | 23 | -23 | -23 | 23 | **42** | **-42** | **-42** | **42** | **30** | **-30** | **-30** | **30** |
| | NON-SELECTION LINE | | | | | | | | | | | |
| | -13 | 13 | 13 | -13 | **6** | **-6** | **-6** | **6** | **-6** | **6** | **6** | **-6** |
| | | | | | 1.5 | 1.5 | 1.5 | 1.5 | 1.5 | 1.5 | 1.5 | 1.5 |

FIG.27

| DATA (3 BITS/PIXEL) | | | OUTPUT VOLTAGE |
|---|---|---|---|
| HIGH ORDER | MEDIUM ORDER | LOW ORDER | |
| 0 | 1 | 1 | +21 V |
| 0 | 1 | 0 | +15 V |
| 0 | 0 | 1 | +9 V |
| 0 | 0 | 0 | 0 V |
| 1 | 0 | 1 | -9 V |
| 1 | 1 | 0 | -15 V |
| 1 | 1 | 1 | -21 V |

LIQUID CRYSTAL DISPLAY DEVICE AND LIQUID CRYSTAL DRIVING METHOD

CROSS-REFERENCE TO RELATED APPLICATION

This application is based upon and claims the benefit of priority of the prior Japanese Patent Application No. 2010-43249, filed on Feb. 26, 2010, and the prior Japanese Patent Application No. 2010-144148, filed on Jun. 24, 2010; the entire contents of which are incorporated herein by reference.

FIELD

The embodiments discussed herein are directed to a liquid crystal display device and a liquid crystal driving method.

BACKGROUND

Recently, the technological development of a liquid crystal display element for electronic paper that can maintain its display state even if there is not power and can rewrite data with low power has become active. One of representative liquid crystal display elements is, for example, a liquid crystal display element that uses cholesteric liquid crystal.

FIG. 33 is a diagram illustrating a molecular structure example of cholesteric liquid crystal. Cholesteric liquid crystal is made by adding addition agent called chiral agent to nematic liquid crystal in which rod-like liquid crystal molecules are arrayed in parallel. For example, as illustrated in FIG. 33, cholesteric liquid crystal made by adding addition agent called chiral agent to nematic liquid crystal has a helical structure in which rod-like liquid crystal molecules are twisted.

FIG. 34 is a diagram illustrating a structural example of liquid crystal panels and illustrates a sectional view seen from its lateral side that is obtained by cutting liquid crystal panels in a vertical direction to a liquid crystal display surface. For example, as illustrated in FIG. 34, a liquid crystal display element is created by laminating liquid crystal panels 34-1 to 34-3 into which cholesteric liquid crystal is injected. A liquid crystal display element that uses cholesteric liquid crystal has an excellent characteristic such as a semi-permanent display retention characteristic, a bright color display characteristic, a high contrast ratio, and a high-resolution characteristic.

Moreover, the molecular structure of cholesteric liquid crystal is changed in accordance with the intensity of an applied electric field. For example, when a strong electric field is given to cholesteric liquid crystal, the helical structure of a liquid crystal molecule uncoils perfectly. As a result, the molecular structure of liquid crystal becomes a so-called homeotropic state in which all molecules are arrayed in accordance with the direction of an electric field. Next, when the electric field is suddenly removed from the homeotropic state, the helix axis of the liquid crystal molecule becomes perpendicular to an electrode. As a result, the molecular structure of liquid crystal becomes a so-called planar state in which light according to a pitch of a helical structure is selectively reflected. On the other hand, when a weak electric field by which the helical structure of a liquid crystal molecule is not unfastened is applied to cholesteric liquid crystal and then the electric field is removed, the helix axis of the liquid crystal molecule becomes parallel to an electrode. As a result, the molecular structure of liquid crystal becomes a so-called focal conic state in which incident light is transmitted. Moreover, when a strong electric field is applied to cholesteric liquid crystal and then the electric field is slowly removed or when a medium-size electric field is applied to cholesteric liquid crystal and then the electric field is suddenly removed, a planar state and a focal conic state coexist.

For example, a liquid crystal display element can display a white color in the case of a planar state and can display a black color in the case of a focal conic state. Moreover, in the case of a coexistence state of a planar state and a focal conic state, a liquid crystal display element can display a half tone between white and black. In this manner, a liquid crystal display element that uses cholesteric liquid crystal performs image display by using a phenomenon by which the structure of a liquid crystal molecule is changed in accordance with the intensity of an applied electric field.

Moreover, the liquid crystal display element described above is connected to a common driver that selects a drawing line for drawing an image and a segment driver that outputs a voltage corresponding to a drawing image. The common driver selects drawing lines on the liquid crystal display element one-by-one. When a drawing line is selected by the common driver, the segment driver applies a voltage according to desired image data to be drawn to the drawing line. The structure of a liquid crystal display element that applies voltages to an electrode of the common driver and an electrode of the segment driver and makes liquid crystal display a desired color is referred to as a passive matrix structure.

FIGS. 35 to 37 are diagrams explaining a driving concept of a liquid crystal display element that has a passive matrix structure. FIG. 35 illustrates a driving concept when a first-line image is drawn on a drawing line of a liquid crystal display element. FIG. 36 illustrates a driving concept when second-line image data is drawn on a drawing line of the liquid crystal display element. FIG. 37 illustrates a driving concept when third-line image data is drawn on a drawing line of the liquid crystal display element.

For example, as illustrated in FIG. 35, when the first line of image data is displayed on a liquid crystal display element, a common driver 35-1 selects a first line of a liquid crystal display element 35-3 as a drawing line 35-5 on the basis of selection line data 35-4. Then, a segment driver 35-2 applies a voltage according to first-line image data 35-6 to the drawing line 35-5 selected by the common driver 35-1.

Moreover, as illustrated in FIG. 36, when the second line of image data is displayed on a liquid crystal display element, a common driver 36-1 selects a second line of a liquid crystal display element 36-3 as a drawing line 36-5 on the basis of selection line data 36-4. Then, a segment driver 36-2 applies a voltage according to second-line image data 36-6 to the drawing line 36-5 selected by the common driver 36-1.

For example, as illustrated in FIG. 37, when the third line of image data is displayed on a liquid crystal display element, a common driver 37-1 selects a third line of a liquid crystal display element 37-3 as a drawing line 37-5 on the basis of selection line data 37-4. Then, a segment driver 37-2 applies a voltage according to third-line image data 37-6 to the drawing line 37-5 selected by the common driver 37-1.

As described above, for example, when a desired image is drawn on one drawing line, a common driver applies an uniform pulse voltage to one electrode corresponding to the drawing line among its electrodes. The common driver applies, for example, a 3 V pulse voltage that does not have an influence on the molecular structure of liquid crystal. The common driver plays a role as a switch that selects a drawing line. On the other hand, a segment driver applies a pulse voltage having the size according to desired image data to be drawn to its electrodes. The segment driver applies, for example, a 25 V pulse voltage to an electrode corresponding to a part of which the image data is a black color and applies, for example, a 50 V pulse voltage to an electrode corresponding to a part of which the image data is a white color. Similarly, the whole image data is displayed on a liquid crystal display element by sequentially applying voltages to drawing lines on the liquid crystal display element.

However, along with the large screen of a display device that uses a liquid crystal display element, the completion of an image display requires a long time and thus a new problem is to speed up the complete display of an image. Therefore, although it is considered that the complete display of an image is speeded up by shortening the application time of an alternate-current pulse voltage to be applied to a liquid crystal display element, there is another problem in that the transition of a molecular structure of liquid crystal is not sufficient.

FIGS. 38 and 39 are diagrams illustrating a relationship between a voltage to be applied to a liquid crystal display element and a reflectance of light. Horizontal axes illustrated in FIGS. 38 and 39 indicate an alternate-current pulse voltage to be applied to a liquid crystal display element and vertical axes illustrated in FIGS. 38 and 39 indicate a reflectance of light of the liquid crystal display element.

FIG. 38 illustrates a reflectance of light of a liquid crystal display element when a pulse voltage is applied with a period of 60 milliseconds. Moreover, a reference number 38-1 illustrated in FIG. 38 indicates a situation where the molecular structure of liquid crystal is transited to a planar state, a focal conic state, and a planar state as an applied voltage becomes large. A reference number 38-2 illustrated in FIG. 38 indicates a situation where the molecular structure of liquid crystal is transited from a focal conic state to a planar state as an applied voltage becomes large. FIG. 39 illustrates a reflectance of light of a liquid crystal display element when a pulse voltage is applied with a period of 10 milliseconds. Moreover, a reference number 39-1 illustrated in FIG. 39 indicates a situation where the molecular structure of liquid crystal is transited to a planar state, a focal conic state, and a planar state as an applied voltage becomes large. A reference number 39-2 illustrated in FIG. 39 indicates a situation where the molecular structure of liquid crystal is transited from a focal conic state to a planar state as an applied voltage becomes large.

When comparing FIG. 38 and FIG. 39, it turns out that the molecular structure is not completely transited from a planar state to a focal conic state when a pulse voltage is applied with a period of 10 milliseconds, unlike the case where a pulse voltage is applied with a period of 60 milliseconds. In other words, when a time length for which a pulse voltage is applied to a liquid crystal display element is shortened to speed up the complete display of an image, the transition of a molecular structure of liquid crystal is not sufficient.

Therefore, there is proposed a previous driving method for sufficiently transiting the molecular structure of liquid crystal while planning speeding up of the complete display of an image. The previous driving method is a method for applying a voltage to a certain drawing line and simultaneously pre-applying a voltage having a predetermined size to a line of liquid crystal to be drawn after that, a so-called previous drive line.

FIG. 40 is a diagram explaining a concept of a conventional previous driving method. As illustrated in FIG. 40, in the previous driving method, a voltage is applied to a drawing line 40-1 and simultaneously a voltage is applied to previous drive lines 40-2 that consist of several tens of lines. In other words, in the previous driving method, an energy applied to sufficiently transit the molecular structure of liquid crystal can be given by previously applying a voltage to a previous drive line. The conventional art has been known as disclosed in, for example, International Publication Pamphlet No. WO 2006/103738.

However, the conventional prior driving method described above has a problem in that an image displayed on a liquid crystal display element has unevenness.

FIG. 41 is a diagram illustrating an example of a voltage that is applied to a liquid crystal display element in the conventional prior driving method. Moreover, a "non-selection line" illustrated in FIG. 41 indicates a line other than a drawing line and a previous drive line described above. Moreover, a "planar" illustrated in FIG. 41 means that the molecular structure of liquid crystal is controlled to a planar state. A "focal conic" illustrated in FIG. 41 means that the molecular structure of liquid crystal is controlled to a focal conic state. Moreover, numeric values described in a part corresponding to a reference number "41-1" illustrated in FIG. 41 indicate the values of pulse voltages that are applied from a common driver to a non-selection line, a drawing line, and a previous drive line. Moreover, numeric values described in a part corresponding to a reference number "41-2" illustrated in FIG. 41 indicate the values of pulse voltages that are applied from a segment driver in accordance with a color of an image to be drawn on a drawing line. Moreover, numeric values described in a part corresponding to a reference number "41-3" illustrated in FIG. 41 indicate synthetic values of a pulse voltage that is applied from the segment driver to a segment of the liquid crystal display element and a pulse voltage that is applied from the common driver to a line of the liquid crystal display element. For example, the numeric values of the reference number "41-3" illustrated in FIG. 41 are values that are obtained by subtracting the numeric values of the reference number "41-1" from the numeric values of the reference number "41-2".

Because a passive matrix structure is a simple lattice structure, a liquid crystal display device having a passive matrix structure has a characteristic that a pulse voltage that is applied to a previous drive line of a liquid crystal display element is the same as a pulse voltage that is applied to a drawing line.

For example, as illustrated by the reference number "41-1" of FIG. 41, the same high-low-mixed pulse voltage is applied from the common driver to the drawing line and the previous drive line. On the other hand, as illustrated by the reference number "41-2" of FIG. 41, a high-low-mixed pulse voltage for controlling the molecular structure of liquid crystal to a planar state or a focal conic state is applied from the segment driver in accordance with a color tone of an image to be drawn on the drawing line.

Then, as illustrated in FIG. 41, the pulse voltage applied to the previous drive line by the segment driver becomes the same as the pulse voltage applied to the drawing line to be a high-low-mixed voltage. For example, as illustrated by "41-4" and "41-5" of FIG. 41, when the molecular structure of liquid crystal is controlled to a planar state, the pulse voltages applied to the previous drive line and the drawing line from the segment driver have the same size. Similarly, as illustrated by "41-6" and "41-7" of FIG. 41, when the molecular structure of liquid crystal is controlled to a focal conic state, the pulse voltages applied to the previous drive line and the drawing line from the segment driver have the same size.

As described above, when a certain line of previous drive lines is a drawing target, the certain line is affected by the pre-applied pulse voltage because the same pulse voltage as that of a drawing line is applied to a previous drive line. For this reason, it can be considered that the molecular structure of liquid crystal is not sufficiently transited depending on the size of a pulse voltage applied to the previous drive line. Therefore, this consequently leads to display an uneven image on a liquid crystal display element.

FIG. 42 is a diagram illustrating an example of an uneven image that is displayed on a liquid crystal display element. As illustrated in FIG. 42, when a liquid crystal display element 42-1 is drawn, for example, in a direction of 42-4, unevenness occurs like the case where a portion 42-2 to be originally displayed with a black color becomes slightly white or like the case where a portion 42-3 to be originally displayed with a white color becomes slightly black.

For example, although it is preferable to transit the molecular structure of liquid crystal to a focal conic state when an image is drawn on a drawing line in a black color, a certain level of a voltage application time is spent to transit to the focal conic state as described above. However, because the transition of a molecular structure of liquid crystal corresponding to a previous drive line is dependent on the size of a voltage applied to a drawing line, the molecular structure may not be sufficiently transited to a focal conic state in some cases. In this case, a difference occurs between the brightness of black color images drawn on the drawing line, and thus a portion such as the portion 42-2 illustrated in FIG. 42 occurs.

For example, although it is preferable to transit the molecular structure of liquid crystal to a planar state when an image is drawn on a drawing line in a white color, a certain level of field intensity is applied to transit to the planar state as described above. However, because the transition of a molecular structure of liquid crystal corresponding to a previous drive line is dependent on the size of a voltage applied to a drawing line, the molecular structure may not be sufficiently transited to a planar state in some cases. In this case, a difference occurs between the brightness of white color images drawn on the drawing line, and thus a portion such as the portion 42-3 illustrated in FIG. 42 occurs.

Moreover, although an uniform voltage can be applied to a previous drive line when an active matrix structure having a switch element is applied to a liquid crystal display element, this is not preferable from the viewpoint of controllability and cost because the structure is complicated.

SUMMARY

According to an aspect of an embodiment of the invention, A liquid crystal display device includes a segment driver that commonly applies, when sequentially scanning a plurality of lines included in a liquid crystal display element to draw an image, a voltage according to image data of the image to a drawing line, a previous drive line, and a non-selection line included in the plurality of lines; a common driver that individually applies voltages to the drawing line, the previous drive line, and the non-selection line; and a voltage setting unit that sets a voltage that is applied from the segment driver and a voltage that is applied from the common driver, in such a manner that a molecular structure of the liquid crystal display element corresponding to the previous drive line becomes a focal conic state regardless of the image data by applying a synthesized voltage of the voltage that is applied from the segment driver and the voltage that is applied from the common driver to the previous drive line.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

BRIEF DESCRIPTION OF DRAWINGS

FIG. 17 is a diagram illustrating a bipolar voltage setting example of using the multivalued driver;

FIG. 18 is a diagram illustrating an example of an applied voltage type according to a fourth embodiment;

FIG. 19 is a diagram illustrating an example of an applied voltage type according to the fourth embodiment;

FIG. 27 is a diagram illustrating a table example that is used by a segment driver or a common driver during operations corresponding to FIG. 26;

DESCRIPTION OF EMBODIMENT

Preferred embodiments of the present invention will be explained with reference to accompanying drawings. The present invention is not limited to the embodiments explained below.

[a] First Embodiment

Figure 1:
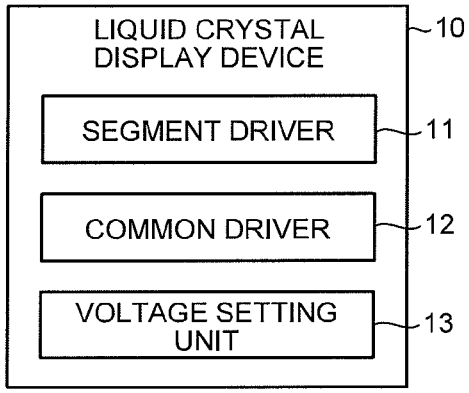
FIG. 1 is a diagram illustrating a liquid crystal display device according to a first embodiment.

FIG. 1 is a diagram illustrating a liquid crystal display device 10 according to the first embodiment. As illustrated in FIG. 1, the liquid crystal display device 10 according to the first embodiment includes a segment driver 11, a common driver 12, and a voltage setting unit 13.

The liquid crystal display device 10 sequentially scans a plurality of lines included in a liquid crystal display element to draw an image on each line. The segment driver 11 applies a voltage to a drawing line that is first scanned, a previous drive line that is next scanned, and a non-selection line that does not correspond to any of the drawing line and the previous drive line. At this time, the segment driver 11 applies the same voltage in accordance with whether the molecular structure of the liquid crystal display element is arranged to a planar state or not a focal conic state. Moreover, the common driver 12 applies different voltages to a drawing line, a previous drive line, and a non-selection line.

The voltage setting unit 13 sets a voltage for arranging the molecular structure of liquid crystal of the previous drive line to a focal conic state even if any voltage of a voltage for arranging the molecular structure of the liquid crystal display element to a planar state and a voltage for arranging the molecular structure to a focal conic state is applied from the segment driver. For example, the voltage setting unit 13 derives a voltage for arranging the molecular structure of the previous drive line to a focal conic state from a voltage that is obtained by synthesizing a voltage output from the segment driver 11 and a voltage output from the common driver 12. Then, the voltage setting unit 13 sets voltages applied from the segment driver 11 and the common driver 12 on the basis of the derived result.

As described above, the liquid crystal display device according to the first embodiment can arrange the molecular structure of liquid crystal of a previous drive line to a focal conic state even if any voltage of a voltage for arranging the molecular structure of a liquid crystal display element to a planar state and a voltage for arranging the molecular structure to a focal conic state is applied from the segment driver 11. In other words, even if an application time of a voltage that is applied to each line of the liquid crystal display element is shortened, the liquid crystal display device can uniformly arrange the molecular structure of liquid crystal of the previous drive line to a focal conic state. For this reason, for example, parts that are drawn with a white color on a line of a previous drive line are unified with the same color tone. As a result, the unevenness of an image can be reduced. Therefore, the liquid crystal display device according to the first embodiment can display an image in a short time and clearly.

[b] Second Embodiment

Voltage Setting Procedure

Figure 2:
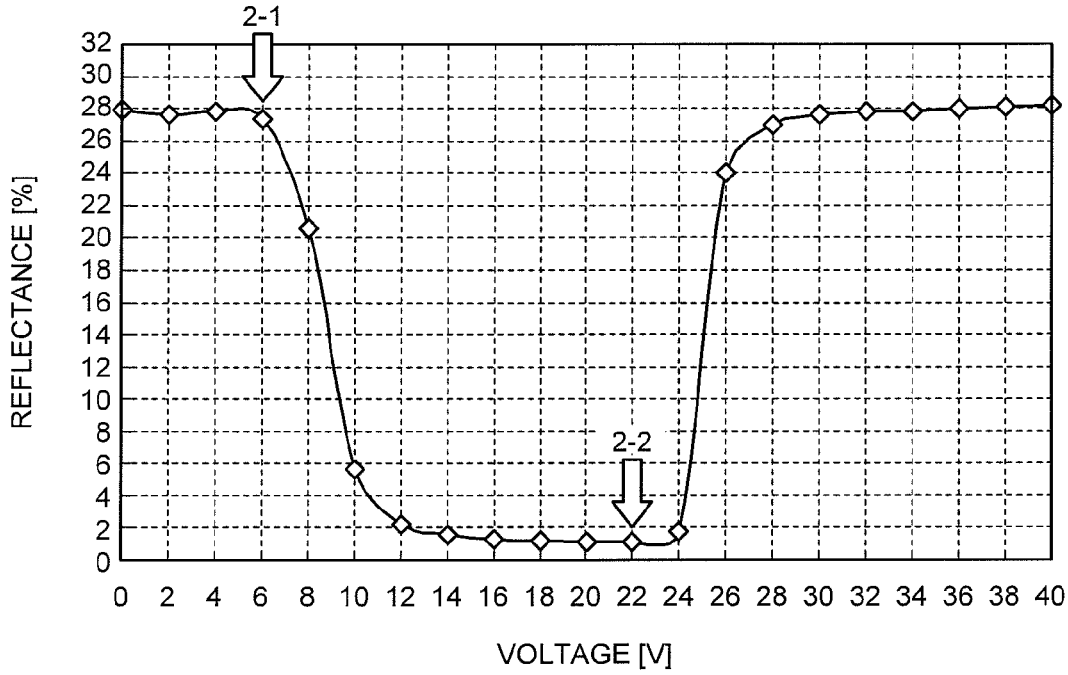
FIG. 2 is a diagram explaining a voltage setting procedure according to a second embodiment.
Figure 3:
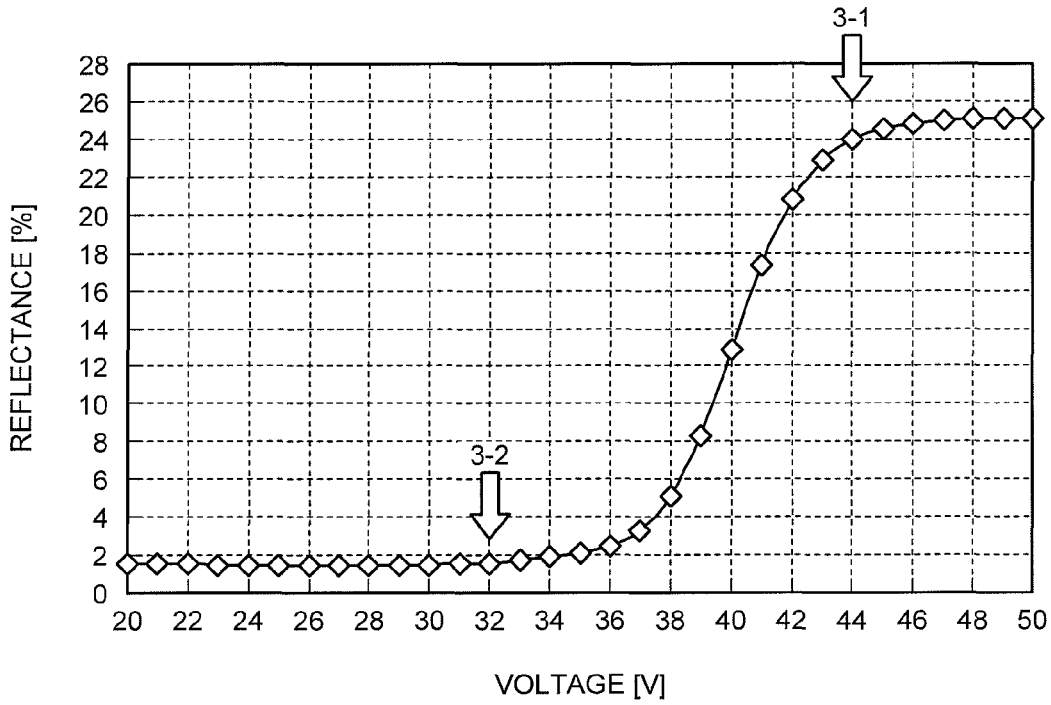
FIG. 3 is a diagram explaining the voltage setting procedure according to the second embodiment.
Figure 4:
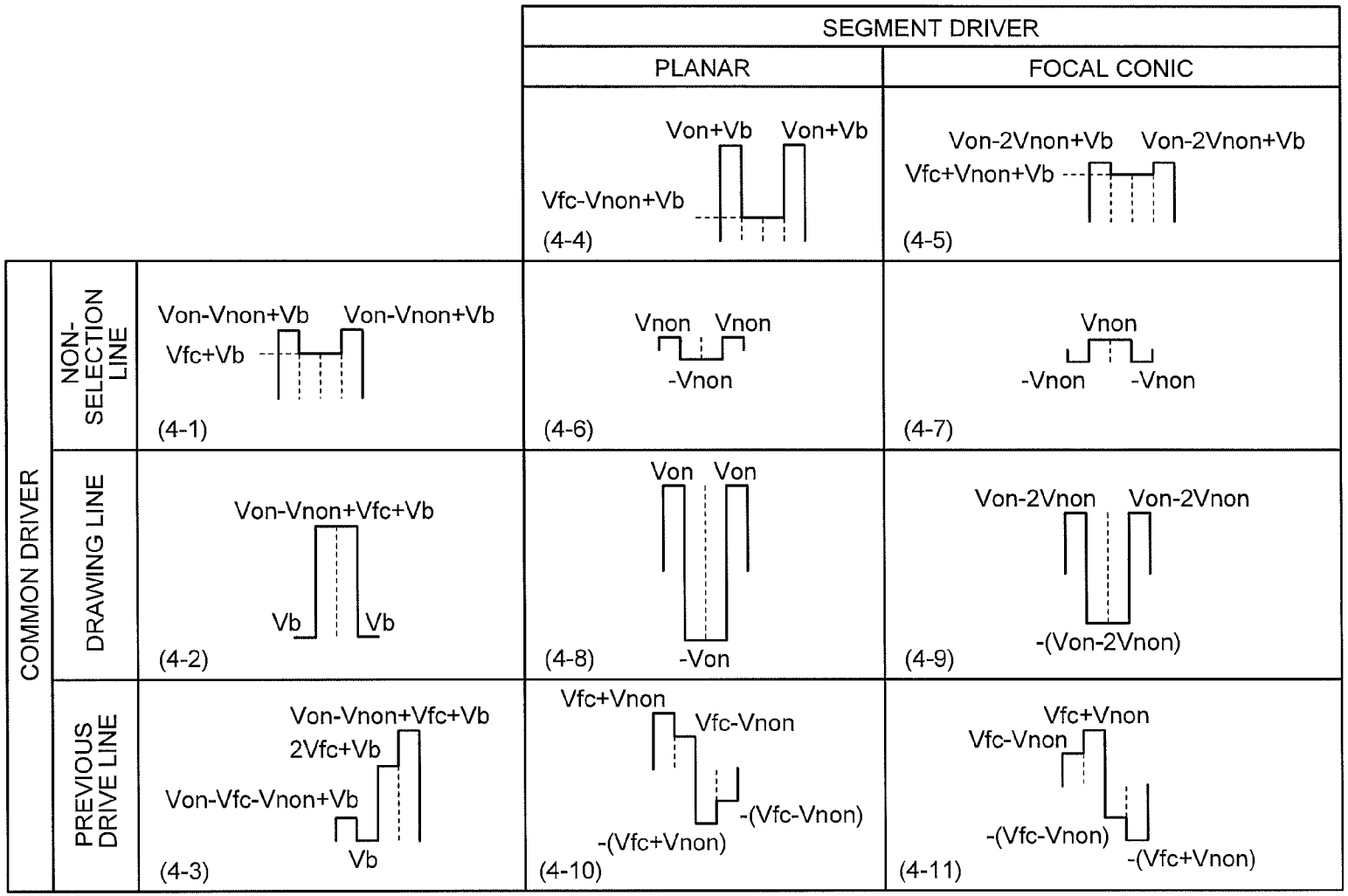
FIG. 4 is a diagram explaining the voltage setting procedure according to the second embodiment.

First, it will be explained about a voltage setting procedure of a liquid crystal display device according to the second embodiment with reference to FIGS. 2 to 4. FIGS. 2 to 4 are diagrams explaining a voltage setting procedure according to the second embodiment.

The liquid crystal display device according to the second embodiment determines a voltage at which the brightness of a liquid crystal display element does not fall as a voltage "Vnon" that is applied to a non-selection line of the liquid crystal display element, on the basis of a relationship between a voltage to be applied to the liquid crystal display element and a reflectance of light of the liquid crystal display element.

FIG. 2 illustrates a relationship between the size of a pulse voltage to be applied to a planar-state liquid crystal display element and a reflectance of light of the liquid crystal display element. Hereinafter, a relationship between a voltage to be applied to a liquid crystal display element and a reflectance of light of the liquid crystal display element is expressed with "voltage-reflectance characteristics". Moreover, it is assumed that FIG. 2 illustrates "voltage-reflectance characteristics" when a pulse voltage having a period of 5 to 10 milliseconds is applied to the liquid crystal display element.

The liquid crystal display device according to the second embodiment determines a voltage as large as possible as a voltage that is applied to a non-selection line without degrading the brightness of a line on which an image is already drawn. For example, the liquid crystal display device according to the second embodiment determines a voltage of about 6 V having a size corresponding to a part 2-1 illustrated in FIG. 2 as the voltage "Vnon" that is applied to the non-selection line. Moreover, the liquid crystal display device according to the second embodiment selects a voltage as large as possible in order to easily transit the molecular structure of liquid crystal later.

Next, the liquid crystal display device according to the second embodiment determines a voltage having a sufficient size for transiting the molecular structure of liquid crystal from a planar state to a focal conic state as a voltage "Vfc" that is applied to a previous drive line on the basis of the "voltage-reflectance characteristics". For example, the liquid crystal display device according to the second embodiment determines a voltage of about 22 V having a size corresponding to a part 2-2 illustrated in FIG. 2 as the voltage "Vfc" that is applied to the previous drive line.

Next, the liquid crystal display device according to the second embodiment measures "voltage-reflectance characteristics" when an image is actually drawn on a drawing line by using the voltage "Vfc" decided as a voltage that is applied to the previous drive line. FIG. 3 illustrates "voltage-reflectance characteristics" when an image is actually drawn on a drawing line by using the voltage "Vfc" decided as a voltage that is applied to the previous drive line.

Then, the liquid crystal display device according to the second embodiment determines a voltage that is applied to a drawing line on the basis of the "voltage-reflectance characteristics" when an image is actually drawn on the drawing line. In other words, the liquid crystal display device according to the second embodiment determines a voltage "Von" when an image is drawn on a drawing line with a white color and a voltage "Voff" when an image is drawn on a drawing line with a black color. Moreover, drawing an image on a drawing line with a white color means that an image is drawn in such a manner that a color of an image that is displayed on the drawing line becomes bright. Moreover, drawing an image on a drawing line with a black color means that an image is drawn in such a manner that a color of an image that is displayed on the drawing line becomes dark.

For example, the liquid crystal display device according to the second embodiment determines a voltage of about 44 V having a size corresponding to a part 3-1 illustrated in FIG. 3 as the voltage "Von" described above. Moreover, it is assumed that a reflectance of light illustrated in FIG. 3 is saturated at 44 V. Moreover, the liquid crystal display device according to the second embodiment calculates "Voff" "Von"−2×"Vnon" and determines, for example, a voltage of about 32 V having a size corresponding to a part 3-2 illustrated in FIG. 3 as the voltage "Voff" described above.

When the determinations of "Vnon", "Vfc", "Von", and "Voff" are finished, the liquid crystal display device according to the second embodiment sets voltages that are applied from a common driver and a segment driver by using "Vnon", "Vfc", "Von", and "Voff". For example, the liquid crystal display device according to the second embodiment assigns the values of "Vnon", "Vfc", "Von", and "Voff" to general formulas illustrated in FIG. 4 to set each voltage. Moreover, "Vb" illustrated in FIG. 4 indicates a base voltage of 0 V.

Figure 5:
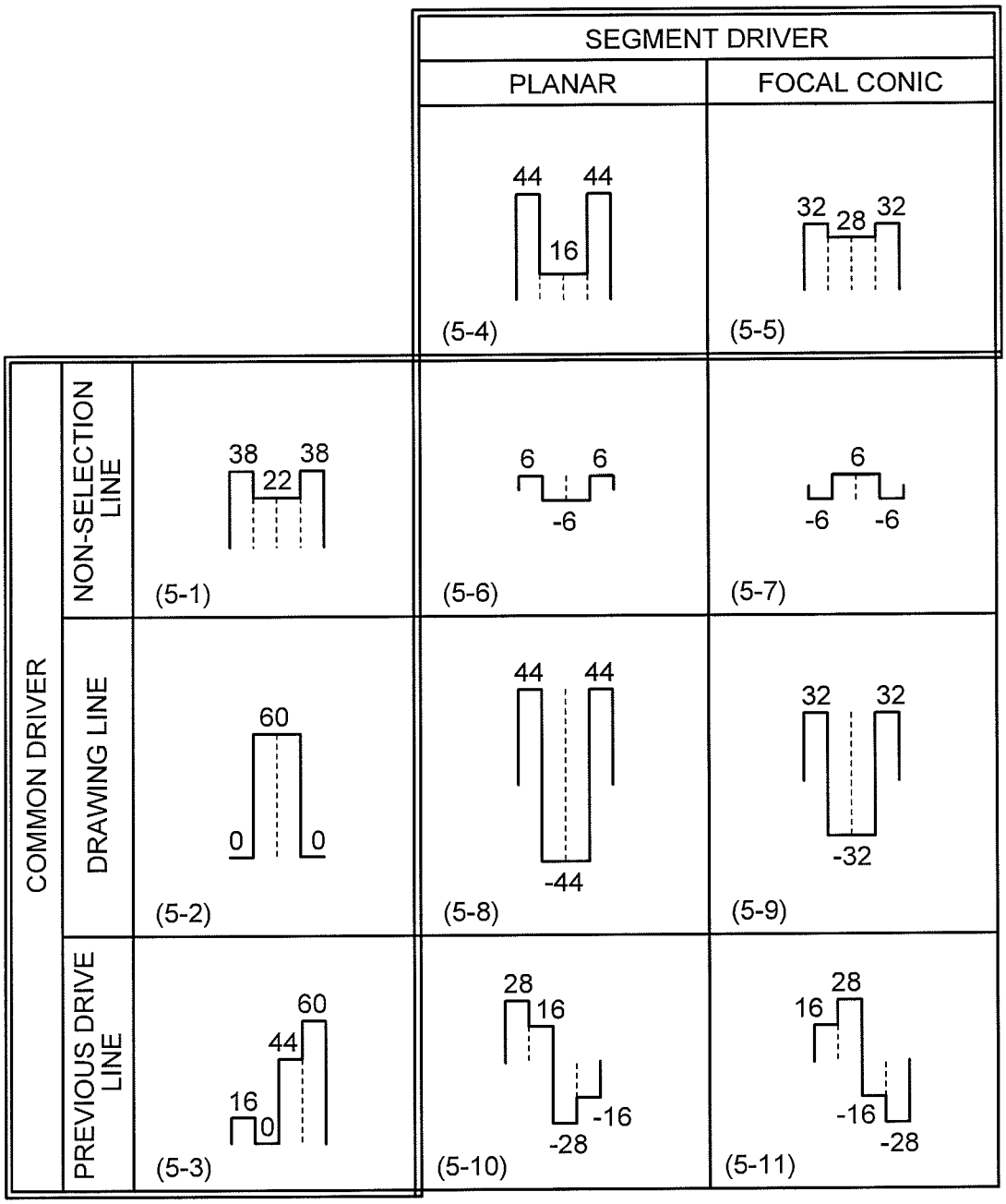
FIG. 5 is a diagram illustrating an example of voltages that are set in a common driver and a segment driver.

"4-1" illustrated in FIG. 4 is a general formula that indicates a voltage that is applied from the common driver to a non-selection line. For example, a voltage that is applied from the common driver to the non-selection line is set like "5-1" illustrated in FIG. 5 by assigning "Vnon=6", "Vfc=22", "Von=44", and "Vb=0". Moreover, FIG. 5 is a diagram illustrating an example of voltages that are set in the common driver and the segment driver.

Moreover, "4-2" illustrated in FIG. 4 is a general formula that indicates a voltage that is applied from the common driver to a drawing line. For example, a voltage that is applied from the common driver to the non-selection line is set like "5-2" illustrated in FIG. 5 by assigning "Vnon=6", "Vfc=22", "Von=44", and "Vb=0".

Moreover, "4-3" illustrated in FIG. 4 is a general formula that indicates a voltage that is applied from the common driver to a previous drive line. For example, a voltage that is applied from the common driver to the previous drive line is set like "5-3" illustrated in FIG. 5 by assigning "Vnon=6", "Vfc=22", "Von=44", and "Vb=0".

Moreover, "4-4" illustrated in FIG. 4 is a general formula that indicates a voltage that is applied from the segment driver when an image is drawn with a white color. For example, a voltage that is applied from the segment driver to the non-selection line is set like "5-4" illustrated in FIG. 5 by assigning "Vnon=6", "Vfc=22", "Von=44", and "Vb=0".

Moreover, "4-5" illustrated in FIG. 4 is a general formula that indicates a voltage that is applied from the segment driver when an image is drawn with a black color. For example, a voltage that is applied from the segment driver to the non-selection line is set like "5-5" illustrated in FIG. 5 by assigning "Vnon=6", "Vfc=22", "Von=44", and "Vb=0". As above, the voltage setting procedure of the liquid crystal display device according to the second embodiment is completed.

Moreover, "4-6" to "4-11" illustrated in FIG. 4 are general formulas that indicate voltages that are applied to the liquid crystal display element at parts at which a voltage applied from the common driver and a voltage applied from the segment driver intersect with each other. A voltage that is applied to the liquid crystal display element is a difference between the voltage applied from the segment driver and the voltage applied from the common driver. For example, a voltage that is applied to the liquid crystal display element is a voltage such as "5-6" to "5-11" illustrated in FIG. 5.

Configuration of Liquid Crystal Display Device

Figure 6:
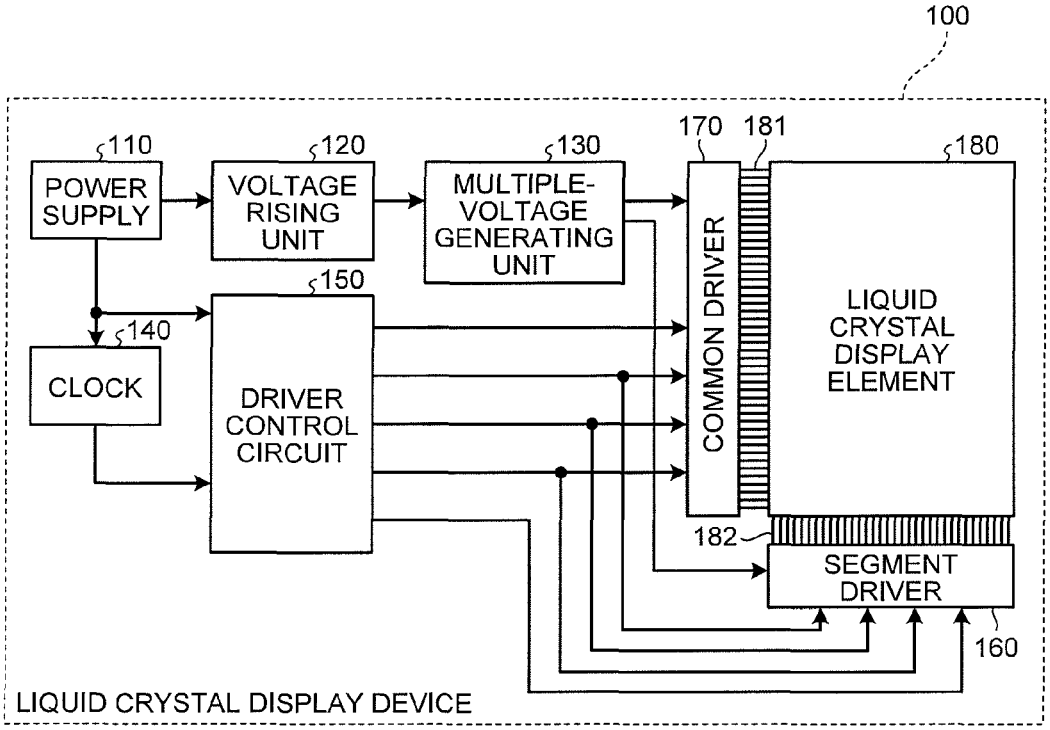
FIG. 6 is a diagram illustrating the configuration of a liquid crystal display device according to the second embodiment.

FIG. 6 is a diagram illustrating the configuration of a liquid crystal display device 100 according to the second embodiment. As illustrated in FIG. 6, the liquid crystal display device 100 according to the second embodiment includes a power supply 110, a voltage rising unit 120, a multiple-voltage generating unit 130, a clock 140, a driver control circuit 150, a segment driver 160, a common driver 170, and a liquid crystal display element 180. In this case, the segment driver 160 and the common driver 170 have a similar driver.

The liquid crystal display element 180 is, for example, a passive matrix display device. The liquid crystal display element 180 is an element that is made by putting cholesteric liquid crystal between substrates in up and down directions perpendicular to a liquid crystal display surface. The substrates between which cholesteric liquid crystal is put have electrodes 181 and 182 that are arranged in a matrix. As illustrated in FIG. 6, the electrodes 181 are arranged in a direction horizontal to the liquid crystal display element 180. Moreover, as illustrated in FIG. 6, the electrodes 182 are arranged in a direction perpendicular to the liquid crystal display element 180. A voltage is introduced into cholesteric liquid crystal by applying the voltage to the electrodes 181 and 182, and thus the molecular structure of cholesteric liquid crystal can be transited.

The power supply 110 outputs a predetermined voltage to the voltage rising unit 120, the clock 140, and the driver control circuit 150. For example, the power supply 110 outputs a voltage of 3 V to 5 V. The voltage rising unit 120 increases the voltage output from the power supply 110 and outputs the increased voltage to the multiple-voltage generating unit 130.

The multiple-voltage generating unit 130 generates various types of voltages by using the voltage output from the voltage rising unit 120. The multiple-voltage generating unit 130 outputs the generated various types of voltages to the segment driver 160 and the common driver 170. The clock 140 outputs a clock signal to the driver control circuit 150.

The driver control circuit 150 outputs various types of data and signals to the segment driver 160 and the common driver 170 to control voltages that are applied to the liquid crystal display element 180. For example, the driver control circuit 150 outputs a data loading clock, a data latching signal, a forced OFF signal, and image data to the segment driver 160. Moreover, the driver control circuit 150 outputs line selection data, a data loading clock, a data latching signal, and a forced OFF signal to the common driver 170. Moreover, the driver control circuit 150 acquires line selection data and image data from a predetermined circuit, which is not illustrated in FIG. 6.

The driver control circuit 150 performs the voltage setting procedure described above and sets voltages that are output from the segment driver 160 and the common driver 170 to a drawing line, a previous drive line, and a non-selection line.

First, the driver control circuit 150 determines a voltage that is applied to the non-selection line on the basis of the "voltage-reflectance characteristics" illustrated in FIG. 2. For example, the driver control circuit 150 determines a voltage as large as possible as a voltage that is applied to the non-selection line without degrading the brightness of a line on which an image is already drawn.

Next, the driver control circuit 150 determines a voltage that is applied to the previous drive line on the basis of the "voltage-reflectance characteristics" illustrated in FIG. 2. For example, the driver control circuit 150 determines a voltage having a sufficient size for transiting the molecular structure of liquid crystal from a planar state to a focal conic state as a voltage that is applied to the previous drive line.

Next, the driver control circuit 150 measures "voltage-reflectance characteristics" when an image is actually drawn on the drawing line by using the voltage decided as a voltage that is applied to the previous drive line. Then, the driver control circuit 150 determines a voltage that is applied to the drawing line by using the "voltage-reflectance characteristics" when the image is actually drawn on the drawing line.

When the determinations of voltages that are applied to the non-selection line, the previous drive line, and the drawing line are finished, the driver control circuit 150 assigns the determined voltages to the general formulas illustrated in FIG. 4 and sets voltages applied from the segment driver 160 and the common driver 170. Then, the driver control circuit 150 outputs various types of data and signals to the segment driver 160 and the common driver 170 in such a manner that the set voltages are applied from the segment driver 160 and the common driver 170 to the liquid crystal display element 180.

The data loading clock described above functions as a signal for informing the segment driver 160 and the common driver 170 of a timing at which data is acquired. Moreover, the data latching signal described above functions as a signal for informing the segment driver 160 and the common driver 170 of a timing at which data is moved to a storage position. Moreover, the forced OFF signal described above functions as a signal for forcibly stopping the application of voltages to the segment driver 160 and the common driver 170.

The segment driver 160 is connected to the electrodes 182 that are arrayed on the liquid crystal display element 180, and applies the same high-low-mixed voltage to the drawing line, the previous drive line, and the non-selection line on the basis of the signal output from the driver control circuit 150. For example, the segment driver 160 applies a voltage for drawing an image on the drawing line with a white color or a black color to the electrodes 182 in accordance with the image data output from the driver control circuit 150. In other words, the segment driver 160 applies, to the electrodes 182, a voltage for transiting the molecular structure of liquid crystal on the drawing line to a planar state or a focal conic state.

Moreover, a drawing line means a line that is first scanned when a plurality of lines included in the liquid crystal display element 180 is sequentially scanned to draw an image on each line. Moreover, a previous drive line means a band of lines that consist of a plurality of lines including a line scanned next to the drawing line. Moreover, a non-selection line means a line that does not correspond to any of the drawing line and the previous drive line, among the plurality of lines included in the liquid crystal display element 180. The non-selection line includes a line on which an image is already drawn.

Figure 7:
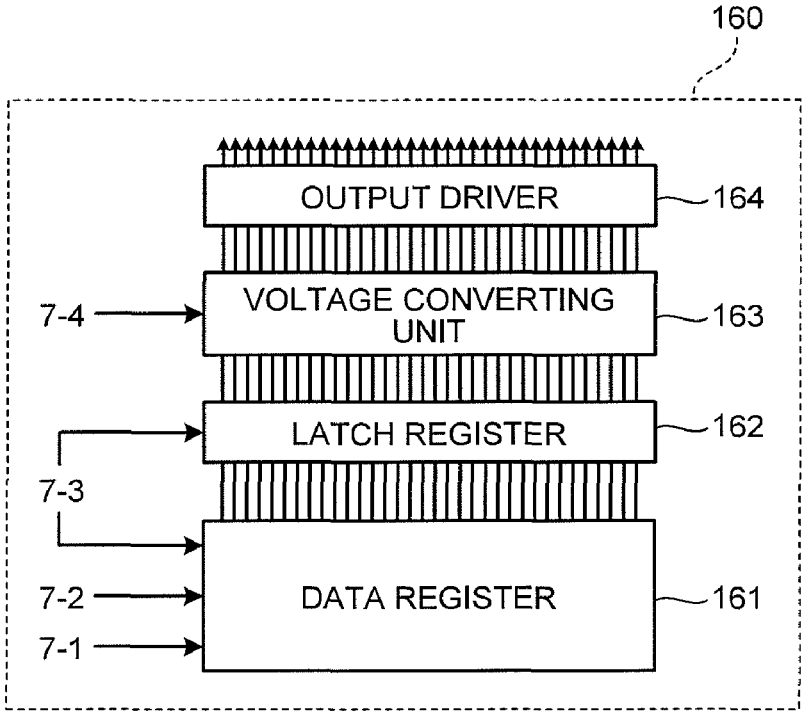
FIG. 7 is a diagram illustrating the configuration of a segment driver according to the second embodiment.

FIG. 7 is a diagram illustrating the configuration of the segment driver according to the second embodiment. As illustrated in FIG. 7, the segment driver 160 includes a data register 161, a latch register 162, a voltage converting unit 163, and an output driver 164. Moreover, "7-1" illustrated in FIG. 7 indicates a data loading clock. Moreover, "7-2" illustrated in FIG. 7 indicates image data. Moreover, "7-3" illustrated in FIG. 7 indicates a data latching signal. Moreover, "7-4" illustrated in FIG. 7 indicates a forced OFF signal.

The data register 161 acquires the image data 7-2 in accordance with the data loading clock 7-1 and stores therein the acquired image data 7-2. Moreover, each time the image data 7-2 is newly acquired, the data register 161 updates the image data 7-2 that is stored therein with the new image data 7-2.

The latch register 162 acquires the image data 7-2 that is stored in the data register 161 in accordance with a timing at which the data latching signal 7-3 is acquired, and stores therein the acquired image data 7-2. Moreover, each time the data latching signal 7-3 is acquired, the latch register 162 acquires the image data 7-2 that is stored in the data register 161 and updates the image data 7-2 that is stored therein with the acquired image data 7-2.

The voltage converting unit 163 informs the output driver 164 of the voltage that is applied to the electrodes 182, on the basis of the image data 7-2 that is stored in the latch register 162. For example, the image data 7-2 has pixel data consisting of combinations of 1 and 0 by the number of the electrodes 182. Then, the voltage converting unit 163 determines, for example, a voltage to be applied to the electrodes 182 in accordance with the image data 7-2 among the voltages supplied from the multiple-voltage generating unit 130 with reference to a predetermined table. Then, the voltage converting unit 163 informs the output driver 164 of the determined voltage.

The output driver 164 is connected to the electrodes 182 of the liquid crystal display element 180. Then, the output driver 164 applies the voltage reported from the voltage converting unit 163 to the electrodes 182.

The common driver 170 is connected to the electrodes 181 that are arrayed on the liquid crystal display element 180, and applies different high-low-mixed voltages to the drawing line, the previous drive line, and the non-selection line on the basis of the signal output from the driver control circuit 150. For example, the common driver 170 applies different high-low-mixed voltages to the drawing line, the previous drive line, and the non-selection line in accordance with the line selection data output from the driver control circuit 150.

Figure 8:
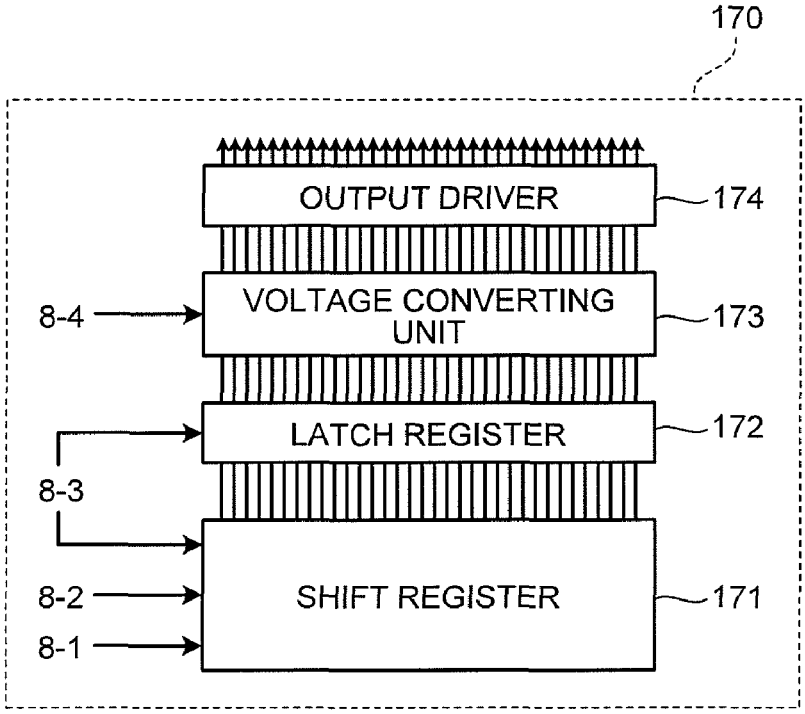
FIG. 8 is a diagram illustrating the configuration of a common driver according to the second embodiment.

FIG. 8 is a diagram illustrating the configuration of the common driver according to the second embodiment. As illustrated in FIG. 8, the common driver 170 includes a shift register 171, a latch register 172, a voltage converting unit 173, and an output driver 174. Moreover, "8-1" illustrated in FIG. 8 indicates a data loading clock. Moreover, "8-2" illustrated in FIG. 8 indicates line selection data. Moreover, "8-3" illustrated in FIG. 8 indicates a data latching signal. Moreover, "8-4" illustrated in FIG. 8 indicates a forced OFF signal.

The shift register 171 acquires the line selection data 8-2 in accordance with the data loading clock 8-1 and stores therein the acquired line selection data 8-2. Moreover, each time the new line selection data 8-2 is acquired, the shift register 171 updates the line selection data 8-2 that is stored therein with the new line selection data.

The latch register 172 acquires the line selection data 8-2 that is stored in the shift register 171 in accordance with a timing at which the data latching signal 8-3 is acquired, and stores therein the acquired line selection data 8-2. Moreover, each time the data latching signal 8-3 is acquired, the latch register 172 acquires the line selection data 8-2 that is stored in the shift register 171 and updates the line selection data 8-2 that is stored therein with the acquired line selection data 8-2.

The voltage converting unit 173 informs the output driver 174 of voltages to be applied to the electrodes 181 on the basis of the line selection data 8-2 that is stored in the latch register 172. For example, the line selection data 8-2 has data consisting of 1 and 0 by the number of the electrodes 181. Then, the voltage converting unit 173 determines voltages to be applied to the electrodes 181 in accordance with the line selection data 8-2 among the voltages supplied from the multiple-voltage generating unit 130, for example, with reference to a predetermined table. Then, the voltage converting unit 173 informs the output driver 174 of the determined voltages.

The output driver 174 is connected to the electrodes 181 of the liquid crystal display element 180. Then, the output driver 174 applies the voltages supplied from the multiple-voltage generating unit 130 to the electrodes 181 on the basis of the data reported from the voltage converting unit 173.

Figures 9, 10:
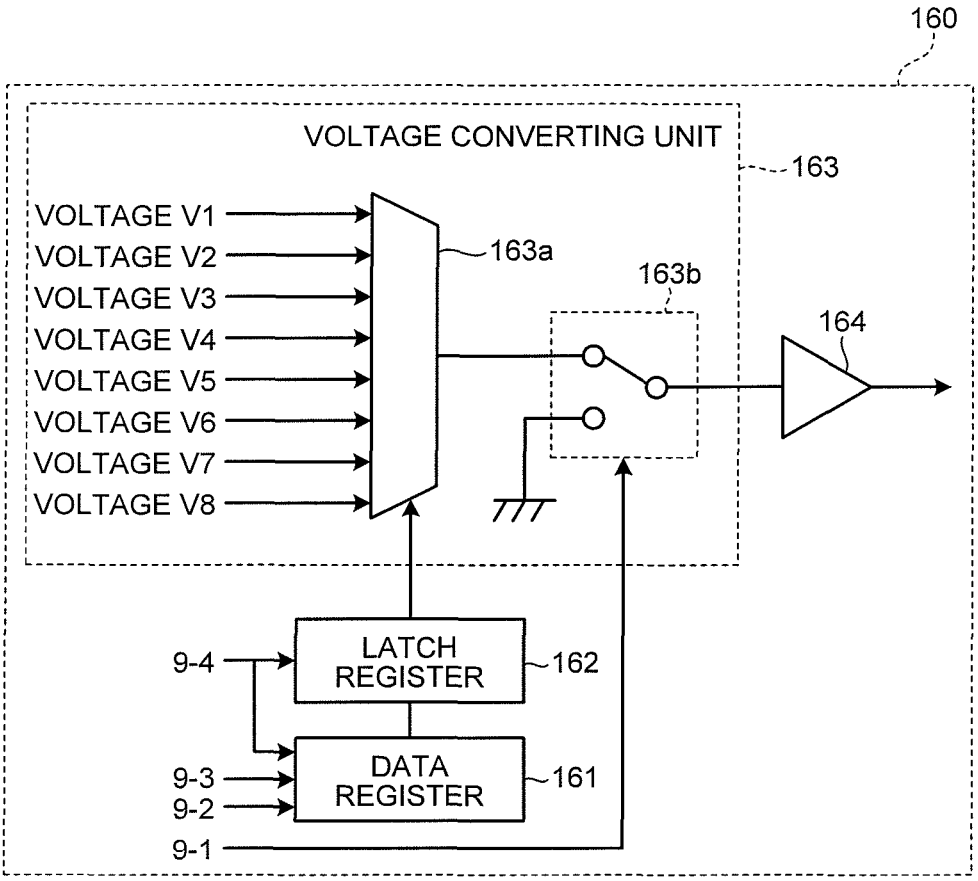
FIG. 9 is a diagram illustrating a circuit configuration example of a voltage converting unit that is included in the segment driver or the common driver.
FIG. 10 is a diagram illustrating a table example that is used when the segment driver or the common driver is operated.

FIG. 9 is a diagram illustrating a circuit configuration example of the voltage converting unit included in the segment driver or the common driver. FIG. 10 is a diagram illustrating a table example that is used when the segment driver or the common driver is operated.

Moreover, because the segment driver 160 or the common driver 170 that is a similar driver is similarly operated, it will be explained about an operation of the voltage converting unit 163 of the segment driver 160 as an example of operations of the voltage converting unit and the output driver.

As illustrated in FIG. 9, the voltage converting unit 163 includes a multiplexer 163*a* and a switch 163*b*. Moreover, "9-1" illustrated in FIG. 9 indicates a forced OFF signal. "9-2" illustrated in FIG. 9 indicates a data loading clock. Moreover, "9-3" illustrated in FIG. 9 indicates image data. Moreover, "9-4" illustrated in FIG. 9 indicates a data latching signal.

The multiplexer 163*a* determines a voltage to be applied to the electrodes 182 in accordance with the image data input from the latch register 162 among the voltages supplied from the multiple-voltage generating unit 130 with reference to a predetermined table.

For example, as illustrated in FIG. 10, the multiplexer 163*a* has a table in which image data of which each pixel consists of 3 bits and an output voltage are associated with each other. When the image data is input from the latch register 162, the multiplexer 163*a* refers to the table illustrated in FIG. 10 and acquires a voltage corresponding to each pixel of the image data among voltages V1 to V8 supplied from the multiple-voltage generating unit 130. Then, the multiplexer 163*a* informs the switch 163*b* of the acquired voltage and the electrode 182 that are associated with each other.

When the notification output from the multiplexer 163*a* is input, the switch 163*b* determines whether the forced OFF signal that is already input from the driver control circuit 150 is "1" or not "0". As the result of determination, when the forced OFF signal is "1", the switch 163*b* is switched to a terminal of the output driver 164 and informs the output driver 164 of a voltage corresponding to each the electrode 182 on the basis of the notification output from the multiplexer 163*a*. On the other hand, when the forced OFF signal is "0", the switch 163*b* is switched to a ground terminal and does not inform the output driver 164 of a voltage corresponding to each the electrode 182.

Process of Liquid Crystal Display Device

Figure 11:
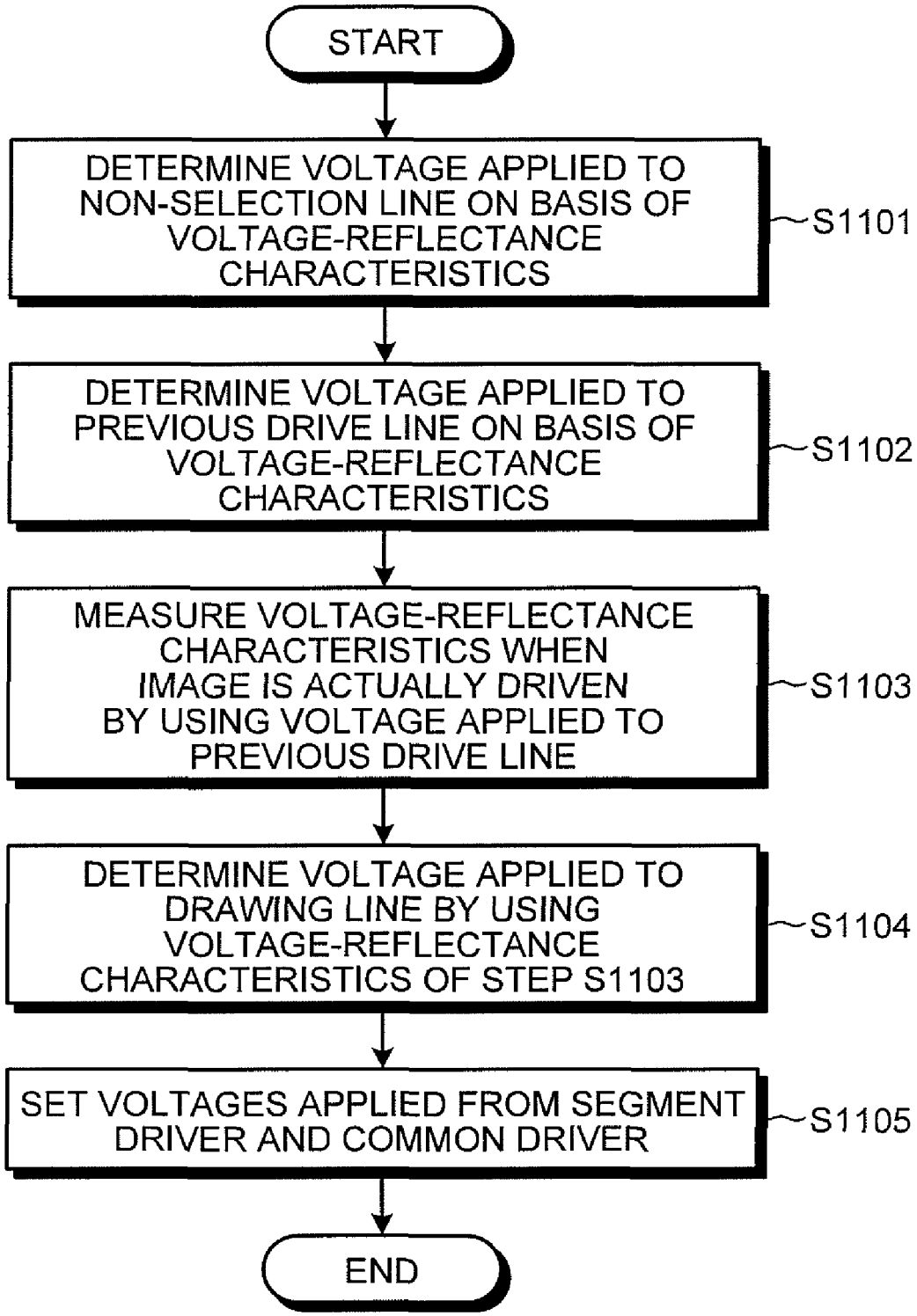
FIG. 11 is a diagram illustrating a flow of a process that is performed by the liquid crystal display device according to the second embodiment.

FIG. 11 is a diagram illustrating a flow of a process that is performed by the liquid crystal display device according to the second embodiment. Moreover, FIG. 11 illustrates a flow of a voltage setting process that is performed by the driver control circuit 150. For example, when the drive of the liquid crystal display element is started, the driver control circuit 150 determines a voltage that is applied to a non-selection line on the basis of the "voltage-reflectance characteristics" illustrated in FIG. 2 as illustrated in FIG. 11 (S1101). For example, the driver control circuit 150 determines a voltage as large as possible as a voltage that is applied to the non-selection line without degrading the brightness of a line on which an image is already drawn.

Next, the driver control circuit 150 determines a voltage that is applied to a previous drive line on the basis of the "voltage-reflectance characteristics" illustrated in FIG. 2 (S1102). For example, the driver control circuit 150 determines a voltage having a sufficient size for transiting the molecular structure of liquid crystal from a planar state to a focal conic state as a voltage that is applied to the previous drive line.

Next, the driver control circuit 150 measures "voltage-reflectance characteristics" when an image is actually drawn on a drawing line by using the voltage decided as a voltage that is applied to the previous drive line (S1103). Then, the driver control circuit 150 determines a voltage that is applied to the drawing line by using the "voltage-reflectance characteristics" measured at Step S1103 (S1104).

When the determinations of voltages that are applied to the non-selection line, the previous drive line, and the drawing line are finished, the driver control circuit 150 sets voltages that are applied from the segment driver 160 and the common driver 170 by using the general formulas illustrated in FIG. 4 (S1105). Then, the driver control circuit 150 terminates the voltage setting process.

Effect of Second Embodiment

As described above, the liquid crystal display device 100 sets a high-low-mixed uniform voltage for arranging the molecular structure of liquid crystal of the previous drive lines to a focal conic state in the segment driver 160 and the common driver 170, for example, as illustrated in FIG. 4. In other words, according to the second embodiment, even the application time of a voltage applied to each line of the liquid crystal display element 180 is shortened, the molecular structure of liquid crystal of the previous drive lines can be uniformly arranged to a focal conic state. For this reason, for example, parts of a line of the previous drive lines that are drawn with a white color are unified with the same color tone. In other words, because a line of previous drive lines that is next drawn is drawn with white having the same brightness as that of the part that is drawn with white, parts that are drawn with a white color have uniformity and contrast between white and black in the line becomes clear. As a result, the unevenness of an image can be reduced. Because of this, according to the second embodiment, the liquid crystal display device 100 sequentially scans a plurality of lines included in the liquid crystal display element 180 to draw an image on each line and thus can display an image in a short time and clearly.

Figure 12:
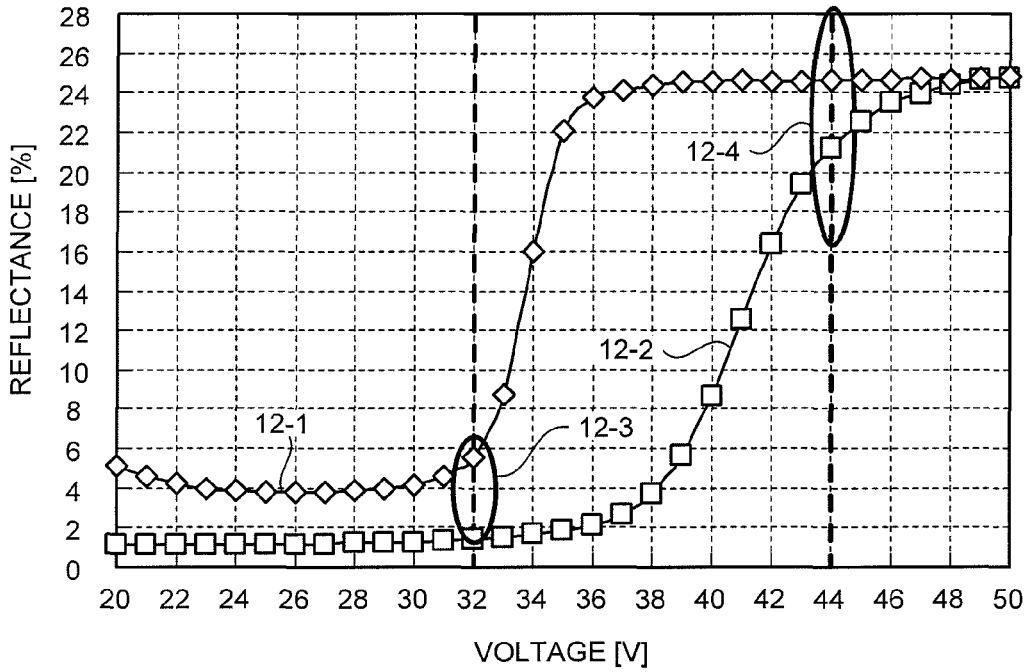
FIG. 12 is a diagram illustrating "voltage-reflectance characteristics" in a conventional liquid crystal driving device.

FIG. 12 is a diagram illustrating "voltage-reflectance characteristics" in a conventional liquid crystal driving device. Moreover, "12-1" illustrated in FIG. 12 indicates "voltage-reflectance characteristics" when an image is actually drawn on a line of previous drive lines in the case where the application of a voltage from the segment driver by which an image is drawn with a white color is continued with a period of 6 milliseconds per one line. Moreover, "12-2" illustrated in FIG. 12 indicates "voltage-reflectance characteristics" when an image is actually drawn on a line of previous drive lines in the case where the application of a voltage from the segment driver by which an image is drawn with a black color is continued with a period of 6 milliseconds.

As illustrated at "12-3" of FIG. 12, when an image is actually drawn on a line of previous drive lines in a planar state, the conventional liquid crystal display device does not sufficiently transit the molecular structure of liquid crystal to a focal conic state. For this reason, a brightness difference occurs between the parts that are drawn on the drawing line with a black color and thus the unevenness of an image occurs like "25-2" illustrated in FIG. 25. Moreover, as illustrated at "12-4" of FIG. 12, when an image is actually drawn on a line of previous drive lines in a focal conic state, the conventional liquid crystal display device does not sufficiently transit the molecular structure of liquid crystal to a planar state. For this reason, a brightness difference occurs between the parts that are drawn on the drawing line with a white color and thus the unevenness of an image occurs like "25-3" illustrated in FIG. 25.

Figure 13:
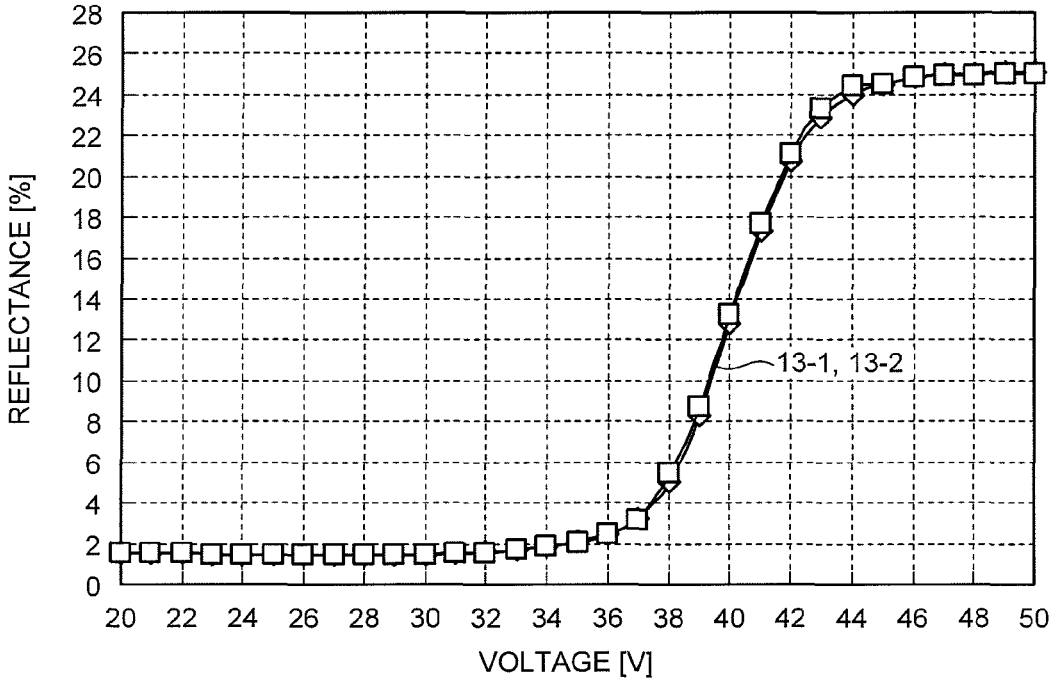
FIG. 13 is a diagram illustrating "voltage-reflectance characteristics" in a liquid crystal driving device according to the second embodiment.

FIG. 13 is a diagram illustrating "voltage-reflectance characteristics" in a liquid crystal driving device according to the second embodiment. Moreover, "13-1" illustrated in FIG. 13 indicates "voltage-reflectance characteristics" when an image is actually drawn on a line of previous drive lines in the case where the application of a voltage from the segment driver 160 by which an image is drawn with a white color is continued with a period of 6 milliseconds per one line. Moreover, "13-2" illustrated in FIG. 13 indicates "voltage-reflectance characteristics" when an image is actually drawn on a line of previous drive lines in the case where the application of a voltage from the segment driver 160 by which an image is drawn with a black color is continued with a period of 6 milliseconds.

As illustrated at "13-1" and "13-2" of FIG. 13, the "voltage-reflectance characteristics" when an image is actually drawn on a line of previous drive lines are the substantially same regardless of the voltages that are applied from the segment driver. From the result illustrated in FIG. 13, it turns out that the parts that are drawn on a line of previous drive lines are unified with the same color tone and thus the unevenness of an image can be reduced.

The application time of a voltage that is applied from the segment driver 160 is only an example. Therefore, even if the application time has a period of 5 milliseconds per one line or even if it has a period of 6 milliseconds per one line, the same result is obtained.

Figure 14:
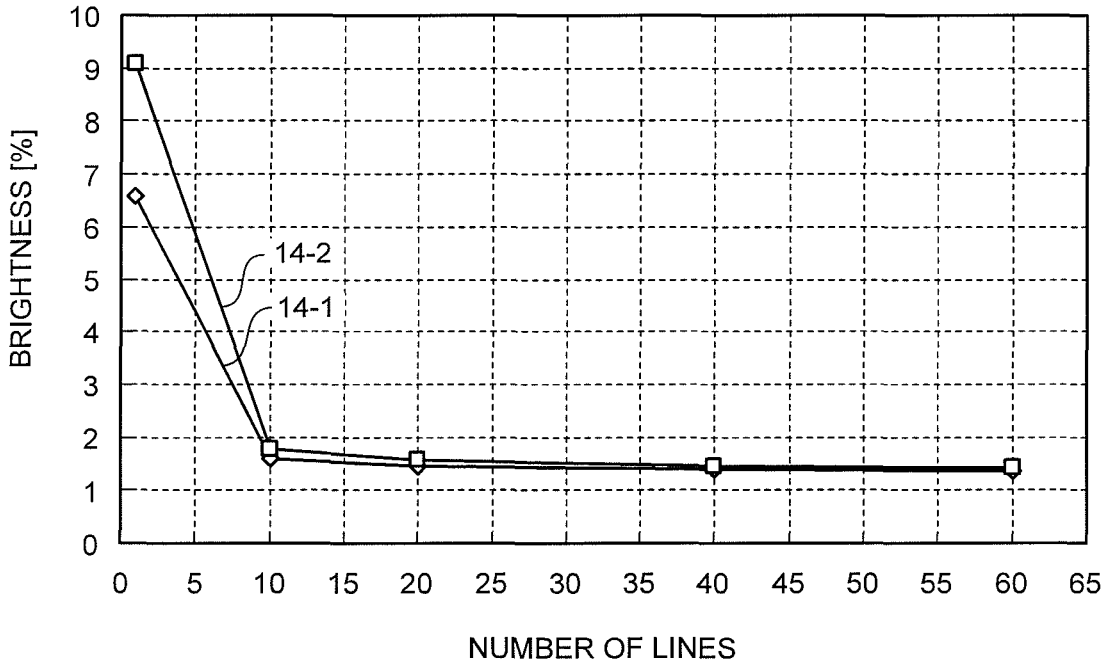
FIG. 14 is a diagram illustrating a relationship between the number of previous drive lines and a brightness of a previous drive line according to the second embodiment.

FIG. 14 is a diagram illustrating a relationship between the number of previous drive lines and the brightness of a previous drive line according to the second embodiment. A horizontal axis illustrated in FIG. 14 indicates the number of lines included in previous drive lines and a vertical axis illustrated in FIG. 14 indicates the brightness of a previous drive line. Moreover, "14-1" illustrated in FIG. 14 indicates a relationship between the number of lines and its brightness when the application of a voltage from the segment driver 160 by which an image is drawn with a white color is continued. Moreover, "14-2" illustrated in FIG. 14 indicates a relationship between the number of lines and its brightness when the application of a voltage from the segment driver 160 by which an image is drawn with a black color is continued with a period of 5 milliseconds. As illustrated in FIG. 14, when the number of lines included in previous drive lines exceeds 10, the brightness of the previous drive lines can be substantially the same regardless of the voltages that are applied from the segment driver 160. Therefore, it is desirable that the number of lines that constitute the previous drive lines is not less than 10 lines if a period per one line is 5 milliseconds. If a period per one line is 6 milliseconds, it is desirable that the number of lines is not less than 9 lines corresponding to a voltage application time of about 50 milliseconds.

[c] Third Embodiment

Figure 15:
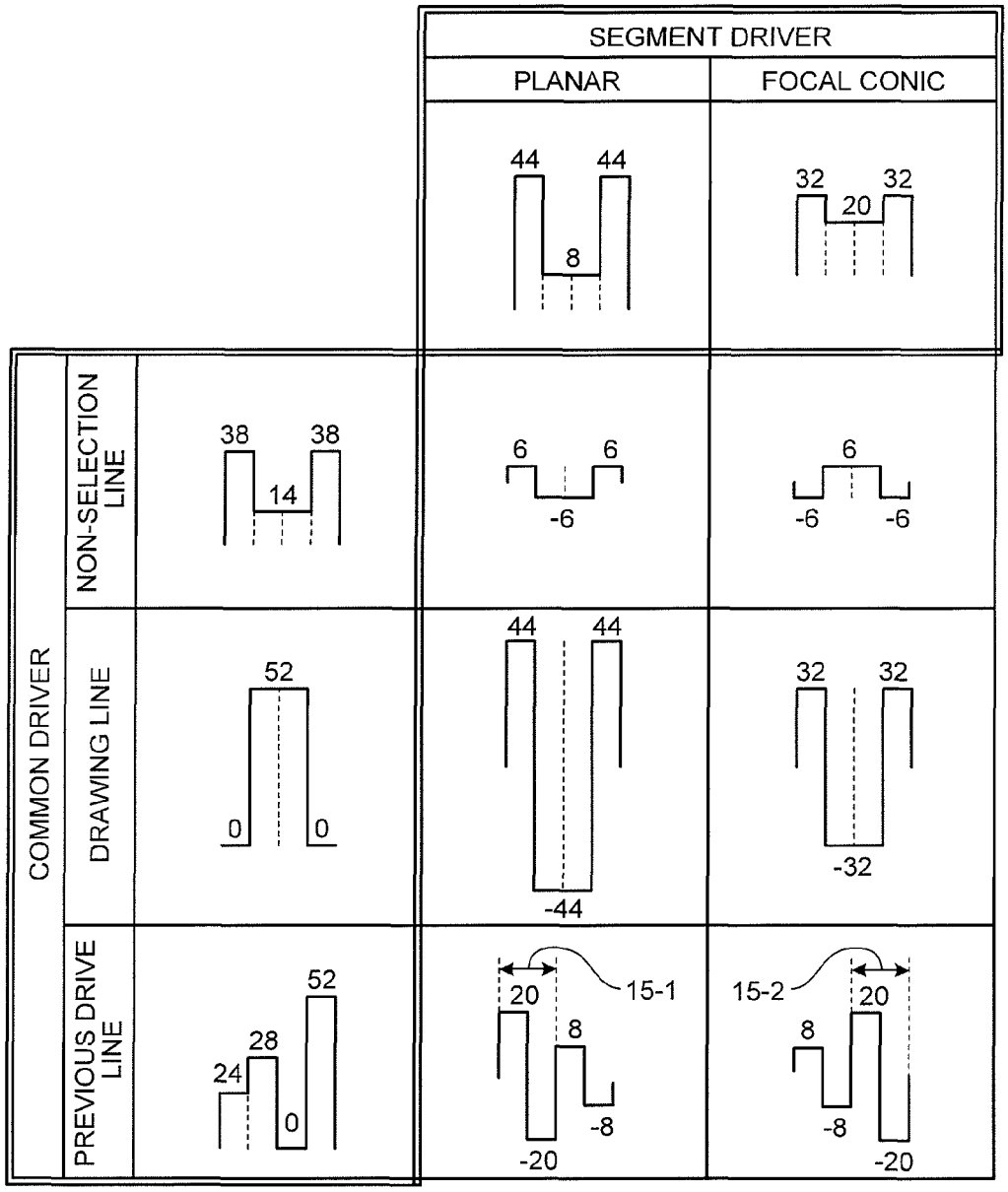
FIG. 15 is a diagram explaining a voltage setting procedure according to a third embodiment.

FIG. 15 is a diagram explaining a voltage setting procedure according to the third embodiment. FIG. 15 illustrates a voltage setting example such that a voltage that is applied to a non-selection line is 6 V and a voltage that is applied to a drawing line is 44 V or 32 V. At this time, the driver control circuit 150 sets voltages applied from the segment driver 160 and the common driver 170 in such a manner that large voltages are continuously applied among high-low-mixed voltages that are applied to previous drive lines.

The driver control circuit 150 sets a voltage as described below when a voltage that is obtained by mixing 20 V and 8 V is applied from the segment driver 160 as a voltage for arranging the molecular structure of liquid crystal of the previous drive lines to a planar state. For example, as illustrated at "15-1" of FIG. 15, the driver control circuit 150 sets voltages applied from the segment driver 160 and the common driver 170 in such a manner that a voltage of 20 V is continuously applied to the previous drive lines.

Moreover, the driver control circuit 150 sets a voltage as described below when a voltage that is obtained by mixing 20 V and 8 V is applied from the segment driver 160 as a voltage for arranging the molecular structure of liquid crystal of the previous drive lines to a focal conic state. For example, as illustrated at "15-2" of FIG. 15, the driver control circuit 150 sets voltages applied from the segment driver 160 and the common driver 170 in such a manner that a voltage of 20 V is continuously applied to the previous drive lines.

As described above, the driver control circuit 150 sets voltages in such a manner that large voltages are continuously applied among high-low-mixed voltages that are applied to previous drive lines. As a result, even if the size of large voltages that are applied to the previous drive lines is small, the driver control circuit 150 can supply energy sufficient to transit the molecular structure of liquid crystal. Because of this, according to the third embodiment, even if a voltage applied to previous drive lines is lower than that of the second embodiment, the molecular structure of liquid crystal of the previous drive lines can be uniformly arranged in a focal conic state. As a result, similarly to the second embodiment described above, the unevenness of an image can be reduced.

[d] Fourth Embodiment

According to the first to third embodiments, the liquid crystal display device employs a driver IC, which can output various voltages, a so-called multivalued driver as a segment driver or a common driver and unifies effective voltages that are applied to previous drive lines irrespective of image data to be drawn on liquid crystal. As a result, because the molecular structure of liquid crystal of the previous drive lines can be transited to a focal conic state, the unevenness of an image is prevented and thus high-contrast liquid crystal display is realized.

However, in order to unify effective voltages to be applied to the previous drive lines irrespective of image data in the embodiments, it is preferable to set a plurality of pulse voltages in a segment driver and a common driver.

Figure 16:
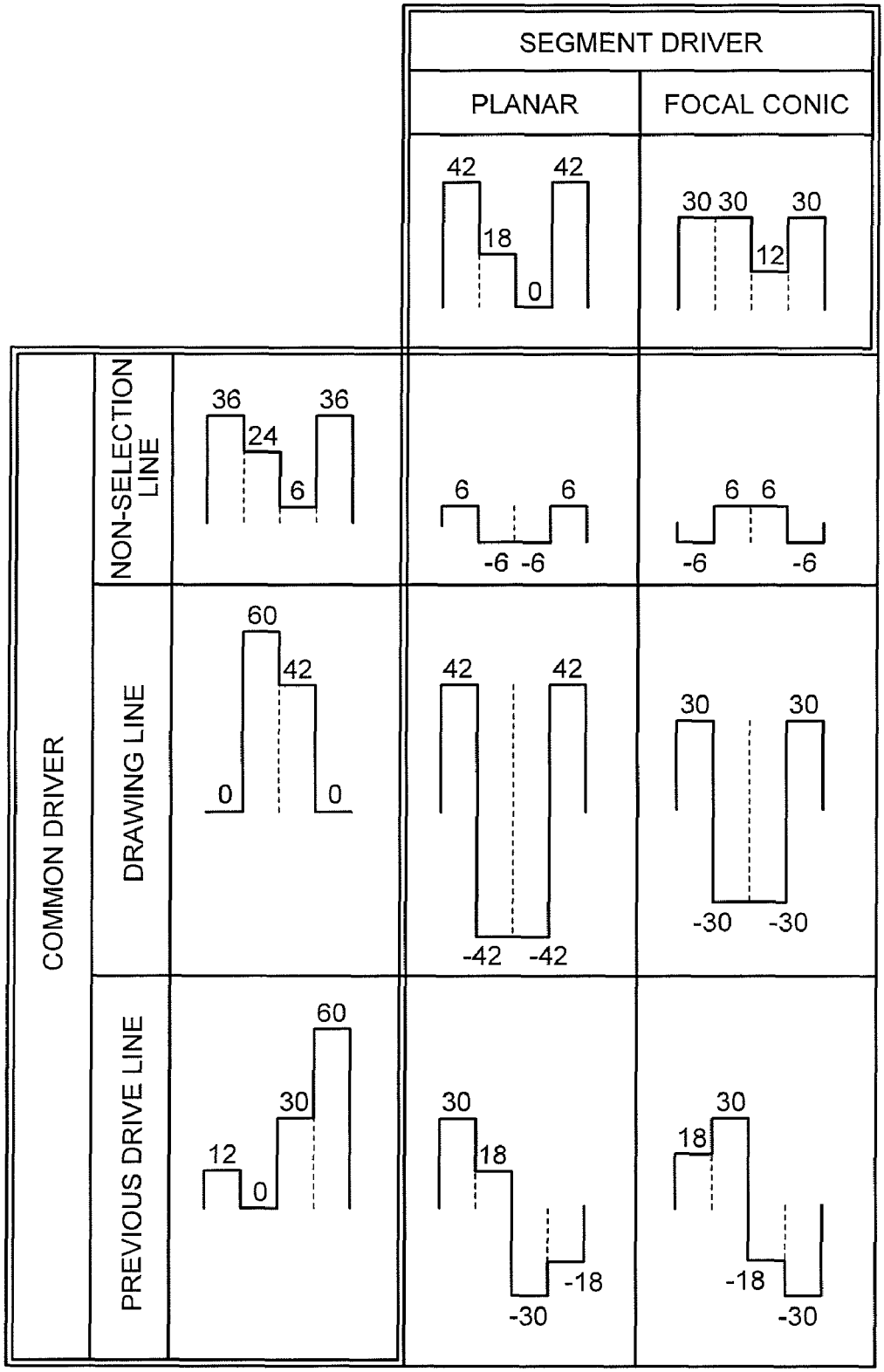
FIG. 16 is a diagram illustrating a unipolar voltage setting example of using a multivalued driver.

FIG. 16 is a diagram illustrating a unipolar voltage setting example that uses a multivalued driver. As illustrated in FIG. 16, when previous drive lines are reset to a planar state and when the previous drive lines are reset to a focal conic state, effective voltages applied to the previous drive lines are unified with "30 V/18 V" or "−30 V/−18 V". In other words, when previous drive lines are reset to a planar state and when the previous drive lines are reset to a focal conic state, the same energy is given to the previous drive lines.

However, as illustrated in FIG. 16, it is preferable to set voltages of "0 V, 6 V, 12 V, 24 V, 30 V, 36 V, 42 V, and 60 V" in the common driver and to set voltages of "0 V, 12 V, 18 V, 30 V, and 42 V" in the segment driver. Moreover, it is preferable to set a voltage of 60 V at a maximum in the common driver. For this reason, it is considered that the driving voltage of a driver becomes high because the number of parts of the driver is increased.

FIG. 17 is a diagram illustrating a bipolar voltage setting example that uses a multivalued driver. Similarly to the case illustrated in FIG. 16, even when bipolar voltage setting is performed, it is preferable to set a plurality of pulse voltages in the segment driver and the common driver. As illustrated in FIG. 17, when liquid crystal is reset to a planar state and when liquid crystal is reset to a focal conic state, the same effective voltages of "20 V/8 V" or "−20 V/−8 V" are applied to the previous drive lines.

However, as illustrated in FIG. 17, when bipolar voltage setting is performed, it is preferable to set voltages of "0 V, 3 V, −3 V, 11 V, −11 V, 25 V, and −25 V" in the common driver. Furthermore, as illustrated in FIG. 17, when bipolar voltage setting is performed, it is preferable to set voltages of "0 V, 5 V, −5 V, 17 V, and −17 V" in the segment driver. Moreover, it is preferable to set voltages of +25 V and −25 V at a maximum in the common driver. Therefore, similarly to the case illustrated in FIG. 16, it is considered that the driving voltage of a driver becomes high because the number of parts of the driver is increased.

Therefore, the liquid crystal display device according to the fourth embodiment sets the voltages that are applied from the segment driver and the common driver in such a manner that a synthesized voltage of which the effective value has a difference in accordance with a difference of image data is applied to the previous drive lines. In this case, a synthesized voltage is a voltage that is obtained by synthesizing a voltage that is applied from the segment driver to the liquid crystal display element and a voltage that is applied from the common driver to the liquid crystal display element.

FIGS. 18 and 19 are diagrams illustrating an example of an applied voltage type according to the fourth embodiment. A longitudinal-direction "18-1" of a rectangular diagram illustrated in FIG. 18 indicates, for example, a voltage level of about ±20 V to ±16 V. Moreover, a lateral-direction "18-2" of the rectangular diagram illustrated in FIG. 18 indicates a pulse width corresponding to a voltage application time. FIG. 18 corresponds to, for example a pulse wave having a medium-voltage continued application type for continuously applying a synthesized voltage of about ±20 V to ±16 V to previous drive lines.

Moreover, a longitudinal-direction "19-1" of a rectangular diagram illustrated in FIG. 19 indicates, for example, a voltage level of about ±32 V to ±4 V. Moreover, a lateral-direction "19-2" of the rectangular diagram illustrated in FIG. 19 indicates a pulse width corresponding to a voltage application time. FIG. 19 corresponds to, for example, a pulse wave having a high-voltage discrete application type for discretely applying a synthesized voltage of ±32 V to the previous drive lines.

The liquid crystal display device according to the fourth embodiment applies, for example, a synthesized voltage having the medium-voltage continued application type according to a pulse wave illustrated in FIG. 18 and a synthesized voltage having the high-voltage discrete application type according to a pulse wave illustrated in FIG. 19 to the previous drive lines. The synthesized voltages of the medium-voltage continued application type and the high-voltage discrete application type are synthesized voltages of which the effective values are changed in accordance with the change of image data and have different energies that are given to the previous drive lines.

Figure 20:
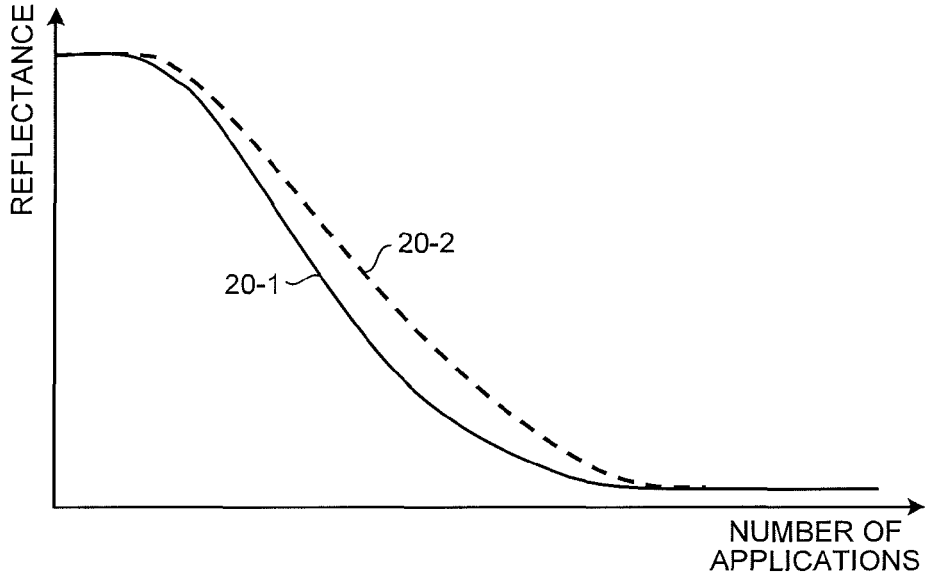
FIG. 20 is a diagram illustrating a relationship between the number of voltage applications and a reflectance of liquid crystal according to the fourth embodiment.

FIG. 20 is a diagram illustrating a relationship between the number of voltage applications and a reflectance of liquid crystal according to the fourth embodiment. A curved line "20-1" illustrated in FIG. 20 indicates a characteristic of a synthesized voltage of a medium-voltage continued application type. A curved line "20-2" illustrated in FIG. 20 indicates a characteristic of a synthesized voltage of a high-voltage discrete application type. As illustrated in FIG. 20, even in the case of any voltage of a synthesized voltage of a medium-voltage continued application type and a synthesized voltage of a high-voltage discrete application type, a reflectance of liquid crystal can be sufficiently reduced in accordance with the increase of the number of voltage applications. In other words, even if any voltage of a synthesized voltage of a medium-voltage continued application type and a synthesized voltage of a high-voltage discrete application type is applied to previous drive lines, the molecular structure of liquid crystal of parts corresponding to the previous drive lines can be sufficiently transited to a focal conic state.

Figure 21:
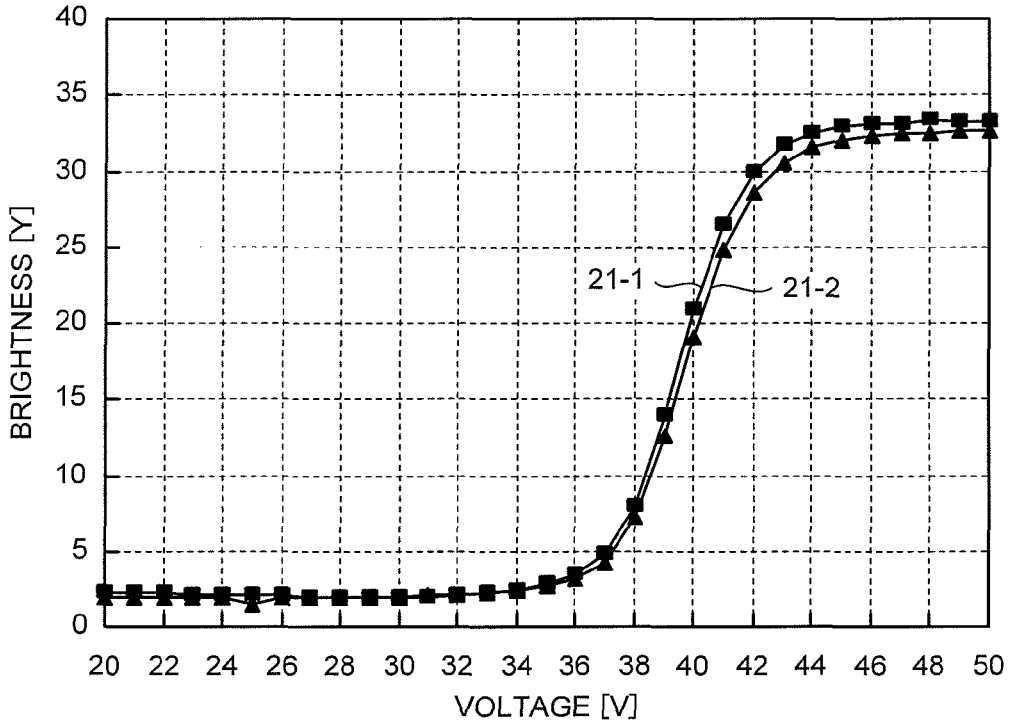
FIG. 21 is a diagram illustrating a response characteristic for each applied voltage type according to the fourth embodiment.

FIG. 21 is a diagram illustrating a response characteristic for each applied voltage type according to the fourth embodiment. A curved line "21-1" illustrated in FIG. 21 indicates a response characteristic when an image is drawn after previous drive lines are reset to a focal conic state at a synthesized voltage of a high-voltage discrete application type of ±32 V to ±4 V. A curved line "21-2" illustrated in FIG. 21 indicates a response characteristic when an image is drawn after the previous drive lines are reset to a focal conic state at a synthesized voltage of a medium-voltage continued application type of ±20 V to ±16 V. As illustrated in FIG. 21, the substantially same response characteristic is obtained regardless of the difference of effective voltages when an image is drawn after the previous drive lines are reset at a synthesized voltage of a high-voltage discrete application type and when an image is drawn after the previous drive lines are reset at a synthesized voltage of a medium-voltage continued application type.

As described above, when effective voltages that are applied to the previous drive lines are largely different in accordance with the change of image data, the molecular structure of liquid crystal of parts corresponding to the previous drive lines can be sufficiently transited to a focal conic state as illustrated in FIG. 20. Moreover, as illustrated in FIG.

21, response characteristics are substantially the same when an image is drawn after the previous drive lines are reset at applied voltages of which the effective voltages are largely different. In the first to third embodiments, as illustrated in FIG. 16, effective voltages that are applied to the previous drive lines are unified irrespective of image data. On the contrary, the liquid crystal display device according to the fourth embodiment does not unify effective voltages that are applied to the previous drive lines. For example, the liquid crystal display device according to the fourth embodiment sets voltages applied from the common driver and the segment driver in such a manner that a synthesized voltage of which the effective value is changed in accordance with the change of image data is applied to the previous drive lines.

Figures 22, 23, 24:
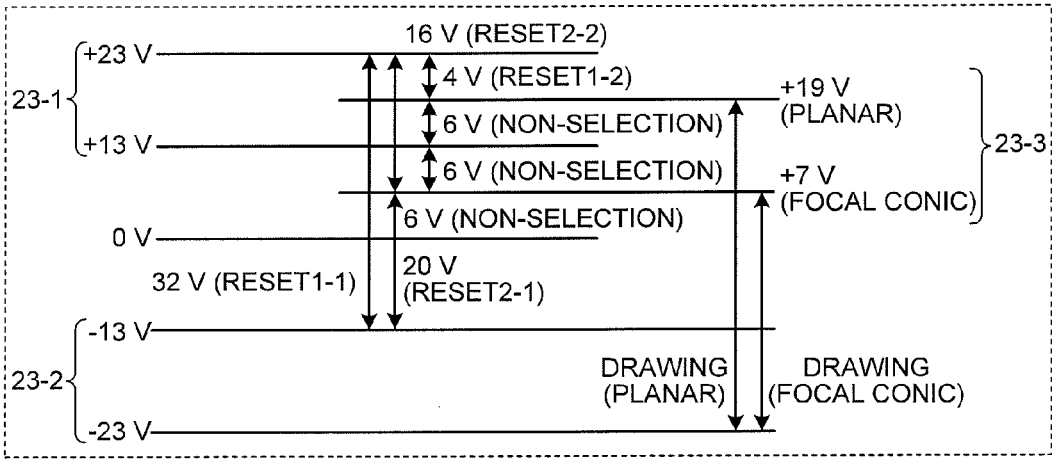
FIG. 22 is a diagram illustrating an example of a setting voltage according to the fourth embodiment.
FIG. 23 is a diagram illustrating a correspondence between a setting voltage of a common driver and a setting voltage of a segment driver according to the fourth embodiment.
FIG. 24 is a diagram illustrating an example of a setting voltage according to the fourth embodiment.

FIG. 22 is a diagram illustrating an example of a setting voltage according to the fourth embodiment. As illustrated in FIG. 22, the liquid crystal display device according to the fourth embodiment sets voltages of "0 V, 13 V, −13 V, 23 V, and −23 V" in the common driver. Moreover, the liquid crystal display device according to the fourth embodiment sets voltages of "0 V, 7 V, −7 V, 19 V, and −19 V" in the segment driver. Then, when a voltage of "−19 V→+19 V→+19 V→−19 V" corresponding to a planar state is applied from the segment driver to the previous drive lines, a voltage of "+13 V→−13 V→+23 V→−23 V" is applied from the common driver to the previous drive lines. As a result, a synthesized voltage of a high-voltage discrete application type of "+32 V→−32 V→+4 V→−4 V" is applied to the previous drive lines. Therefore, the molecular structure of liquid crystal of the parts corresponding to the previous drive lines is sufficiently transited to a focal conic state as described above by using FIG. 20.

Moreover, when a voltage of "−7 V→+7 V→+7 V→−7 V" corresponding to a focal conic state is applied from the segment driver to the previous drive lines, a synthesized voltage of a medium-voltage continued application type of "+20 V→−20 V→+16 V→−16 V" is applied to the previous drive lines. Therefore, the molecular structure of liquid crystal of the parts corresponding to the previous drive lines is sufficiently transited to a focal conic state as described above by using FIG. 20. Moreover, numeric values "0.45, 2.55" illustrated in the lowest stage of FIG. 22 indicate a pulse width (millisecond) by which a voltage is applied to a relevant segment.

FIG. 23 is a diagram illustrating a correspondence between a setting voltage of the common driver and a setting voltage of the segment driver according to the fourth embodiment. FIG. 23 illustrates a correspondence between a setting voltage of the common driver and a setting voltage of the segment driver in FIG. 22. In this case, "23-1" of FIG. 23 indicates "+ (positive)" voltages "+23 V, +13 V" that are set in the common driver. "23-2" of FIG. 23 indicates "− (negative)" voltages "−23 V, −13 V" that are set in the common driver. "23-3" of FIG. 23 indicates "+ (positive)" voltages "+19 V, +7 V" that are set in the segment driver. Moreover, a voltage of "+19 V" that is applied from the segment driver to a line on liquid crystal is a voltage for making the molecular structure of liquid crystal transit to a planar state to draw a "white display" on the line. Moreover, a voltage of "+7 V" that is applied from the segment driver to a line on liquid crystal is a voltage for making the molecular structure of liquid crystal transit to a focal conic state to draw a "black display" on the line.

FIG. 24 is a diagram illustrating an example of a setting voltage according to the fourth embodiment. As illustrated in FIG. 24, the liquid crystal display device according to the fourth embodiment sets voltages of "0 V, 13 V, −13 V, 23 V, and −23 V" in the common driver. Moreover, the liquid crystal display device according to the fourth embodiment sets voltages of "0 V, 7 V, −7 V, 19 V, and −19 V" in the segment driver. Then, when a voltage of "−19 V→+19 V→+19 V→−19 V" corresponding to a planar state is applied from the segment driver to the previous drive lines, a voltage of "0 V→0 V→+23 V→−23 V" is applied from the common driver to the previous drive lines. As a result, a synthesized voltage of the discrete type of "+19 V→−19 V→+4 V→−4 V" is applied to the previous drive lines.

Moreover, when a voltage of "−7 V→+7 V→+7 V→−7 V" corresponding to a focal conic state is applied from the segment driver to the previous drive lines, a synthesized voltage of the continued type of "+7 V→−7 V→+16 V→−16 V" is applied to the previous drive lines. Moreover, a numeric value "1.5" illustrated in the lowest stage of FIG. 24 indicates a pulse width by which a voltage is applied to a relevant segment.

In this case, the case of FIG. 22 and the case of FIG. 24 are compared about the transition of an applied voltage to previous drive lines. In the case illustrated in FIG. 22, when the molecular structure of liquid crystal is transited to a planar state to draw a "white display" on a line, a synthesized voltage of a high-voltage discrete application type of "±32 V (0.9 milliseconds)→±4 V" (5.1 milliseconds) is applied. On the contrary, in the case illustrated in FIG. 24, a synthesized voltage of "±19 V (3.0 milliseconds)→±4 V" (3.0 milliseconds) is applied when a "white display" is drawn. Moreover, in the case illustrated in FIG. 22, when the molecular structure of liquid crystal is transited to a focal conic state to draw a "black display" on a line, a synthesized voltage of a medium-voltage continued application type of "±20 V (0.9 milliseconds)→±16 V" (5.1 milliseconds) is applied. On the contrary, in the case illustrated in FIG. 24, a synthesized voltage of "±7 V (3.0 milliseconds)→±16 V" (3.0 milliseconds) is applied when a "black display" is drawn.

Figure 35:
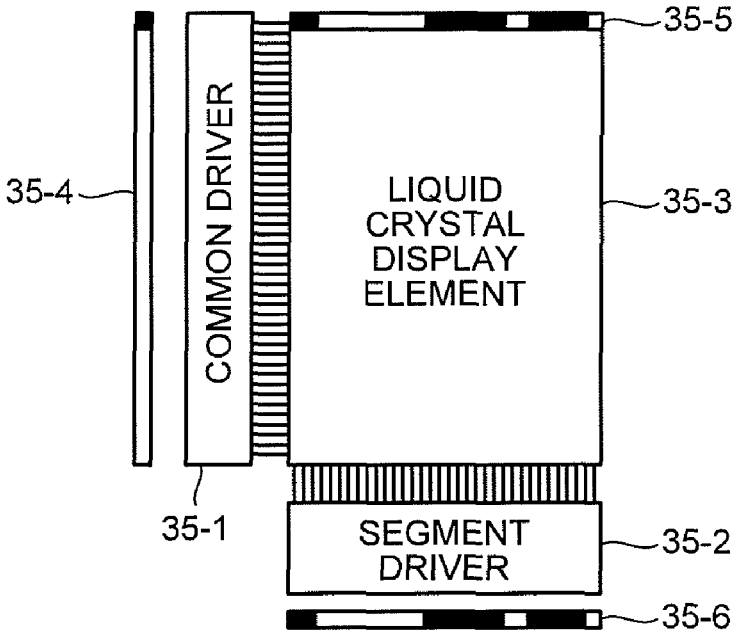
FIG. 35 is a diagram explaining a driving concept of a liquid crystal display element that has a passive matrix structure.
Figure 36:
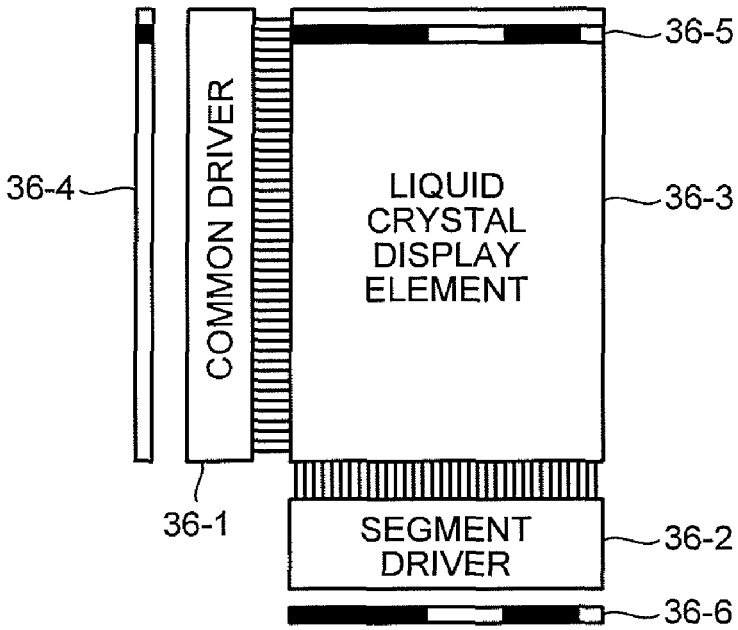
FIG. 36 is a diagram explaining a driving concept of the liquid crystal display element that has a passive matrix structure.
Figure 37:
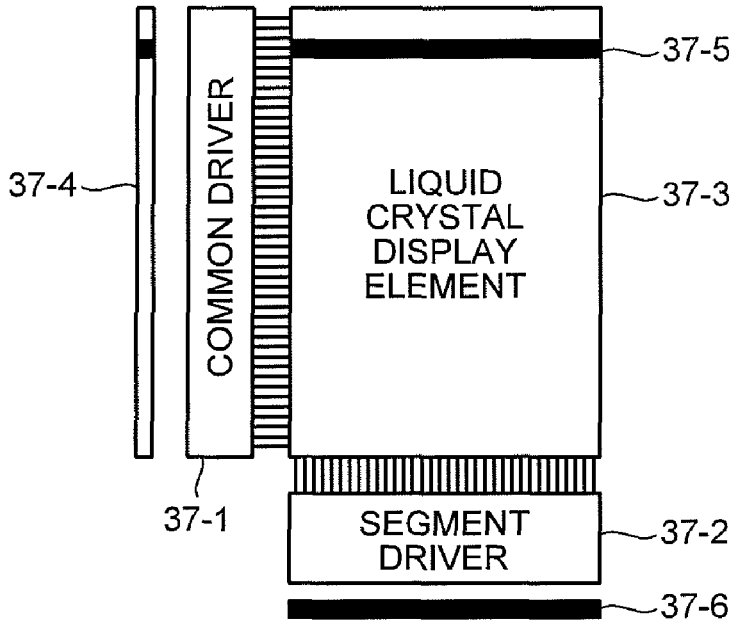
FIG. 37 is a diagram explaining a driving concept of the liquid crystal display element that has a passive matrix structure.
Figure 38:
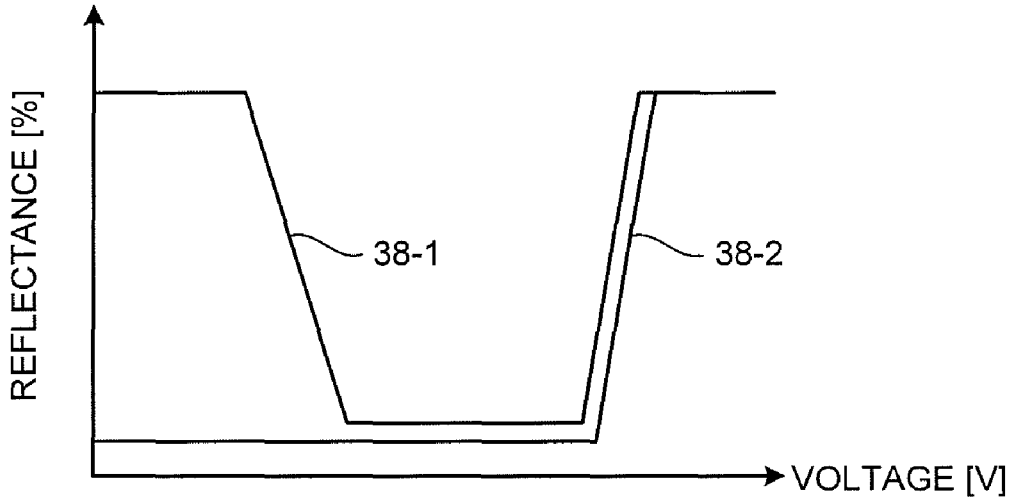
FIG. 38 is a diagram illustrating a relationship between a voltage applied to a liquid crystal display element and a reflectance of light.
Figure 39:
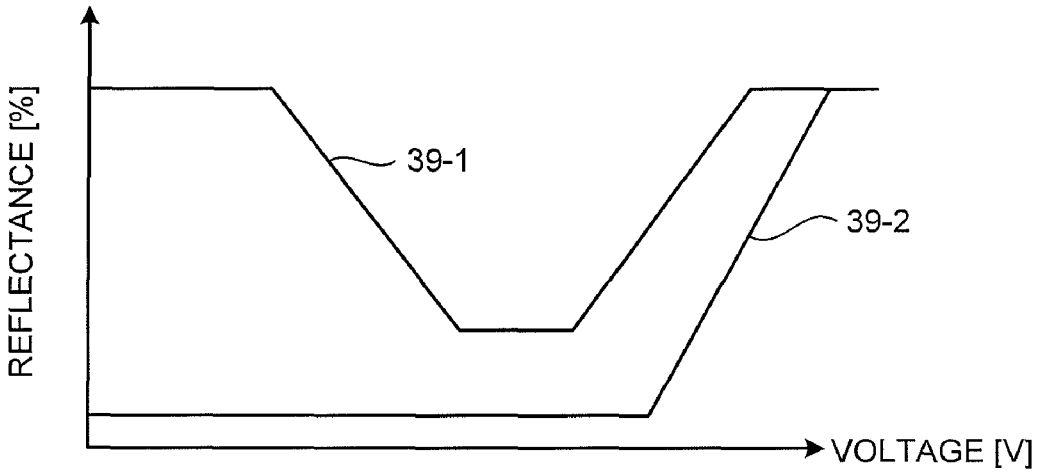
FIG. 39 is a diagram illustrating a relationship between a voltage applied to the liquid crystal display element and a reflectance of light.
Figure 40:
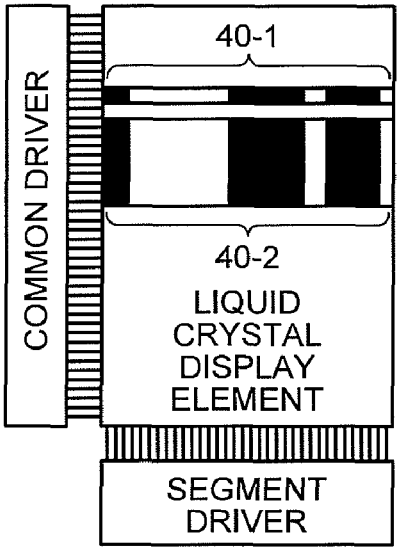
FIG. 40 is a diagram explaining a concept of a conventional previous driving method.
Figure 41:
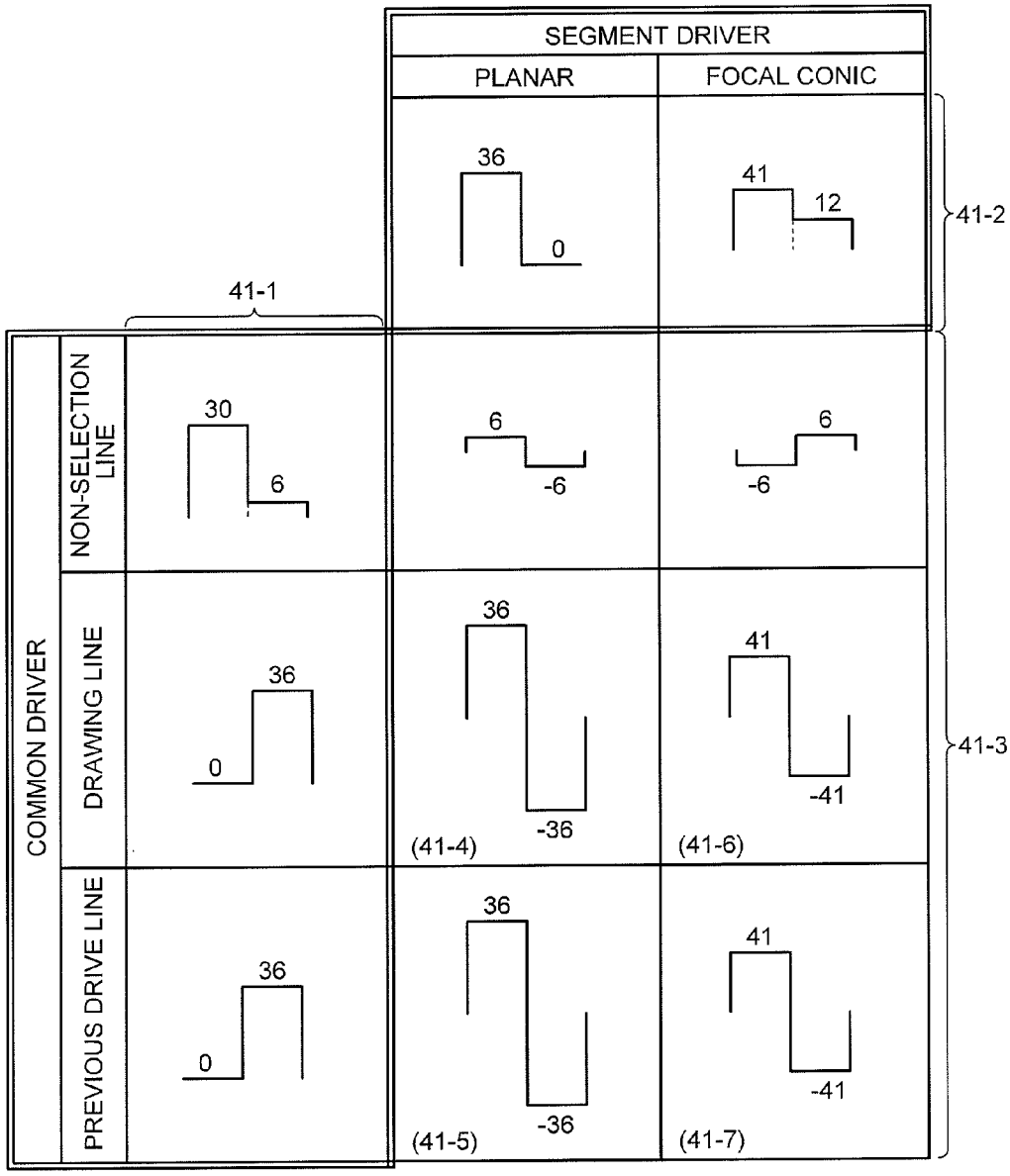
FIG. 41 is a diagram illustrating an example of a voltage that is applied to a liquid crystal display element in the conventional previous driving method.
Figure 42:
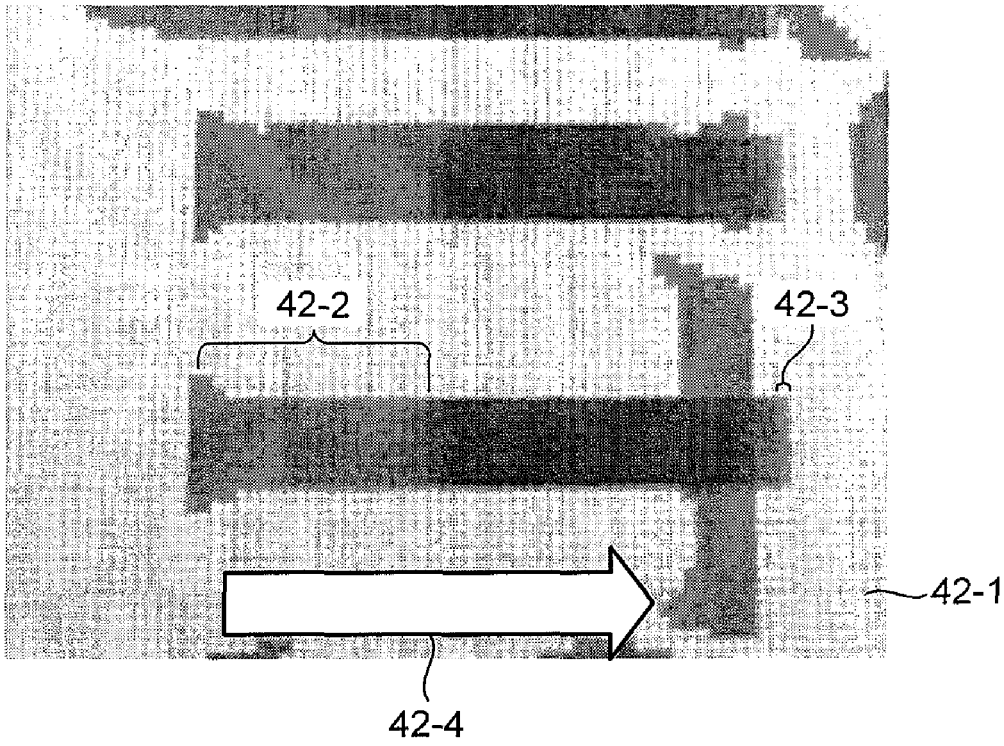
FIG. 42 is a diagram illustrating an example of unevenness of an image that is displayed on the liquid crystal display element.

When a "white display" and a "black display" are drawn, it turns out that a synthesized voltage applied to the previous drive lines is relatively high in the case of FIG. 22 compared to the case of FIG. 24. For example, a passive matrix type liquid crystal display device as illustrated in FIGS. 35 to 37 gives priority to the case where a synthesized voltage applied to the previous drive lines is relatively high.

Moreover, although the configuration of the liquid crystal display device according to the fourth embodiment is similar to, for example, that of the second embodiment described above, a voltage setting method performed by the driver control circuit 150 illustrated in FIG. 6 is different in the embodiments. For example, the driver control circuit 150 illustrated in FIG. 6 sets voltages that are output from the segment driver 160 and the common driver 170 to the drawing line, the previous drive lines, and the non-selection line. At this time, the driver control circuit 150 sets voltages applied from the segment driver 160 and the common driver 170 in such a manner that a synthesized voltage of which the effective value is changed in accordance with the change of image data is applied to the previous drive lines.

For example, the driver control circuit 150 calculates combinations of a voltage level and a pulse width that satisfy the following condition (1) about a synthesized voltage of a medium-voltage continued application type illustrated in FIG. 18 and a synthesized voltage of a high-voltage discrete application type illustrated in FIG. 19. Moreover, "$V_L$" illustrated in the following (1) corresponds to a voltage level and "T" illustrated in the following (1) corresponds to a pulse width.

"values of $V_L^2 \times T \sim V_L^4 \times T$ or $V_L^3 \times T$ are in a range of a predetermined value" (1)

Next, the driver control circuit 150 acquires two combinations of a voltage and a pulse width from a plurality of combinations of the voltage and pulse width that satisfy the condition of the above (1). Then, the driver control circuit 150 determines one combination as a synthesized voltage of a medium-voltage continued application type to be applied to the previous drive lines and determines the other combination as a synthesized voltage of a high-voltage discrete application type to be applied to the previous drive lines, among the acquired combinations. Then, the driver control circuit 150 sets the voltages applied from the segment driver 160 and the common driver 170 in such a manner that the synthesized voltages of the medium-voltage continued application type and the high-voltage discrete application type are applied to the previous drive lines. In other words, the driver control circuit 150 sets the voltages applied from both the drivers in such a manner that the synthesized voltages of the medium-voltage continued application type and the high-voltage discrete application type are applied to the previous drive lines in accordance with the voltage level and pulse width that satisfy the condition of the above (1).

Effect by Fourth Embodiment

As described above, the liquid crystal display device according to the fourth embodiment sets the voltages applied from the common driver and the segment driver in such a manner that a synthesized voltage of which the effective value is changed in accordance with the change of image data is applied to the previous drive lines. Then, the liquid crystal display device according to the fourth embodiment applies a synthesized voltage of which the effective value is changed in accordance with the change of image data to the previous drive lines to sufficiently transit the molecular structure of the previous drive lines to a focal conic state. Therefore, according to the fourth embodiment, an image can be displayed in a short time and clearly similarly to the first to third embodiments. Moreover, in the first to third embodiments, it was preferable to set a plurality of different voltage values by using a multivalued driver in order to unify effective voltages that are applied to the previous drive lines irrespective of image data. On the other hand, unlike the first to third embodiments, the liquid crystal display device according to the fourth embodiment can reduce the number of voltage values set to the drivers compared to the first to third embodiments because effective voltages that are applied to the previous drive lines are different. Therefore, according to the fourth embodiment, the number of parts of a driver can be reduced compared to the first to third embodiments.

Moreover, the liquid crystal display device according to the fourth embodiment sets the voltages applied from both the drivers in such a manner that the synthesized voltages of the medium-voltage continued application type and the high-voltage discrete application type are applied to the previous drive lines in accordance with the voltage level and pulse width that satisfy the condition of the above (1). In other words, the liquid crystal display device according to the fourth embodiment can freely determine the synthesized voltages of the medium-voltage continued application type and the high-voltage discrete application type from the plurality of combinations of the voltage level and pulse width that satisfy the condition of the above (1). Therefore, the liquid crystal display device according to the fourth embodiment can set, for example, a voltage value set in the common driver as low as possible.

[e] Fifth Embodiment

It will be explained about another embodiment of the display device and the display device driving method disclosed in the present application.

(1) Multi-Tone Expansion

In the fourth embodiment, it has been explained about the case where a two-tone display such as a "white display" and a "black display" is performed, for example, as illustrated in FIG. 22. However, the present invention is not limited to this. For example, a multi-tone display of a "white display", a "half-tone display", and a "black display" may be performed. In the case of a two-tone display, as illustrated in FIG. 22, four phases for one line are prepared for each of a "white display" corresponding to a planar state and a "black display" corresponding to a focal conic state. On the contrary, in the case of a multi-tone display, one line is drawn by two stages of a first half and a second half of which the polarities of output voltages of the segment driver are different and eight phases for each half are prepared. An eight-tone display can be performed at a maximum by changing the allocation of white data and black data of the segment driver in the eight phases.

Figure 25:
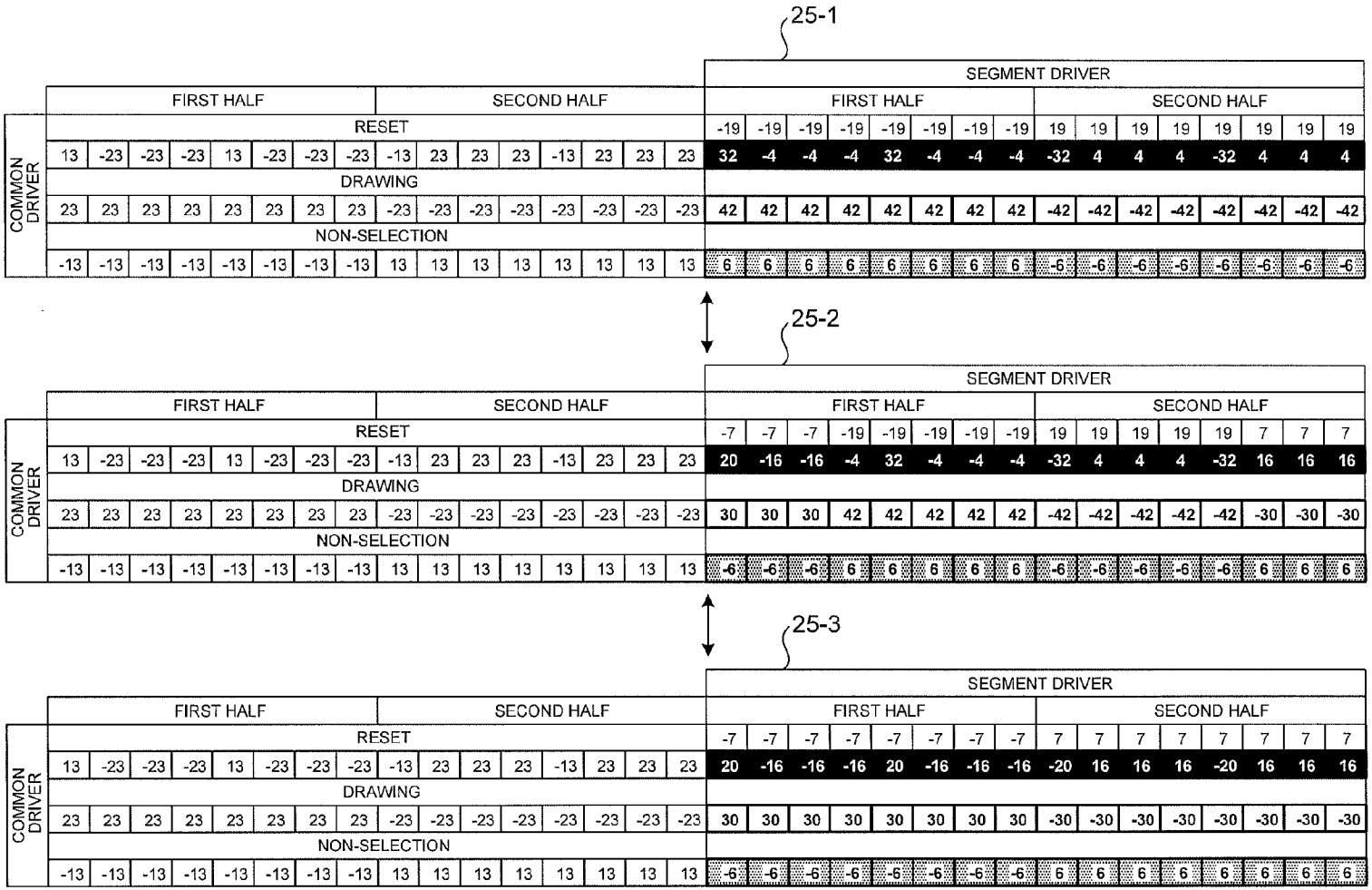
FIG. 25 is a diagram illustrating an example of multi-tone expansion according to a fifth embodiment.

FIG. 25 is a diagram illustrating an example of multi-tone expansion according to the fifth embodiment. In this case, "25-1" of FIG. 25 indicates an example of voltage setting when a "white display" is performed. "25-2" of FIG. 25 indicates an example of voltage setting when a "half-tone display" is performed. "25-3" of FIG. 25 indicates an example of voltage setting when a "black display" is performed.

As illustrated at "25-2" of FIG. 25, because a synthesized voltage of "±42 V" or "±30 V" is applied to a drawing line in a mixed manner when a "half-tone display" is performed, a half-tone display that is obtained by mixing a "white display" and a "black display" is obtained. It is preferable to continue the "±42 V" and "±30 V" without digitizing them from the viewpoint of power consumption. For example, "±42 V" are arranged in the central site of the first half and the second half.

Moreover, as illustrated at "25-1" of FIG. 25, because a synthesized voltage of "±32 V⇔±4 V" is applied to the previous drive lines when a "white display" is performed, the molecular structure of liquid crystal is reset to a focal conic state. Moreover, as illustrated at "25-3" of FIG. 25, because a synthesized voltage of "±20 V⇔±16 V" is applied to the previous drive lines when a "black display" is performed, the molecular structure of liquid crystal is reset to a focal conic state.

(2) Setting Maximum Voltage Common to Both Drivers

Figure 26:
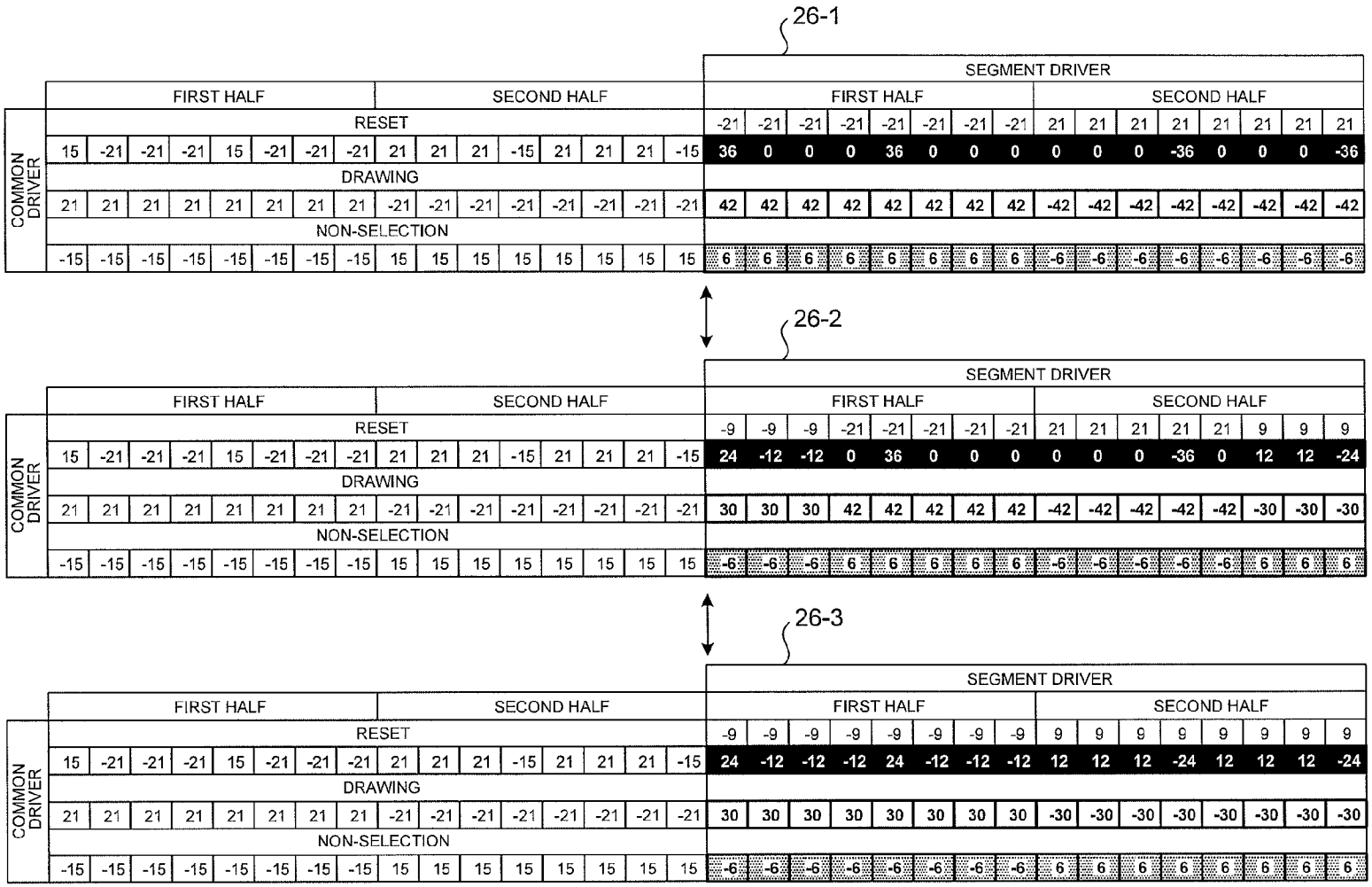
FIG. 26 is a diagram illustrating an example of commonalization of a setting voltage according to the fifth embodiment.

At the time of multi-tone expansion described above, the same voltage value may be set as the maximum voltage applied from the segment driver and the maximum voltage applied from the common driver. FIG. 26 is a diagram illustrating an example of commonalization of a setting voltage according to the fifth embodiment. In this case, "26-1" of FIG. 26 indicates an example of voltage setting when a "white display" is performed similarly to "25-1" of FIG. 25. "26-2" of FIG. 26 indicates an example of voltage setting when a "half-tone display" is performed similarly to "25-2" of FIG. 25. "26-3" of FIG. 26 indicates an example of voltage setting when a "black display" is performed similarly to "25-3" of FIG. 25.

As illustrated in FIG. 26, when a "white display", a "half-tone display", or a "black display" is performed, the same voltage value "±21 V" is set as the maximum voltage applied from the segment driver and the maximum voltage applied from the common driver. For example, when a voltage that is set in the common driver and a voltage that is set in the segment driver are combined in FIG. 25, nine voltages of "0 V, ±7 V, ±13 V, ±19 V, and ±23 V" are obtained. On the contrary, when a voltage that is set in the common driver and a voltage that is set in the segment driver are combined in FIG. 26, seven voltages of "0 V, ±9 V, ±15 V, and ±21 V" are obtained. In other words, the number of setting voltages is reduced even during multi-tone expansion and thus the number of parts of a driver can be reduced, by setting the maximum voltage "±21 V" common to both the drivers.

Now, it will be explained about operations of a common driver and a segment driver in FIG. 26 with reference to FIGS. 27 to 29. In this case, the common driver of FIG. 26 includes, for example, a shift register, a latch register, a voltage converting unit, and an output driver as illustrated in FIG. 8, similarly to the second embodiment described above. Moreover, the segment driver of FIG. 26 includes, for example, a data register, a latch register, a voltage converting unit, and an output driver as illustrated in FIG. 7, similarly to the second embodiment described above. The common driver and the segment driver of FIG. 26 apply voltages to a drawing line, a previous drive line, and a non-selection line on liquid crystal on the basis of a signal that is output from a driver control circuit, similarly to the second embodiment described above.

FIG. 27 is a diagram illustrating a table example that is used by the segment driver and the common driver during operations corresponding to FIG. 26. As illustrated in FIG. 27, the table holds data consisting of three bits for each pixel and an output voltage in association with each other. The common driver and the segment driver of FIG. 26 perform operations corresponding to FIG. 26 by using the table illustrated in FIG. 27.

Figure 28:
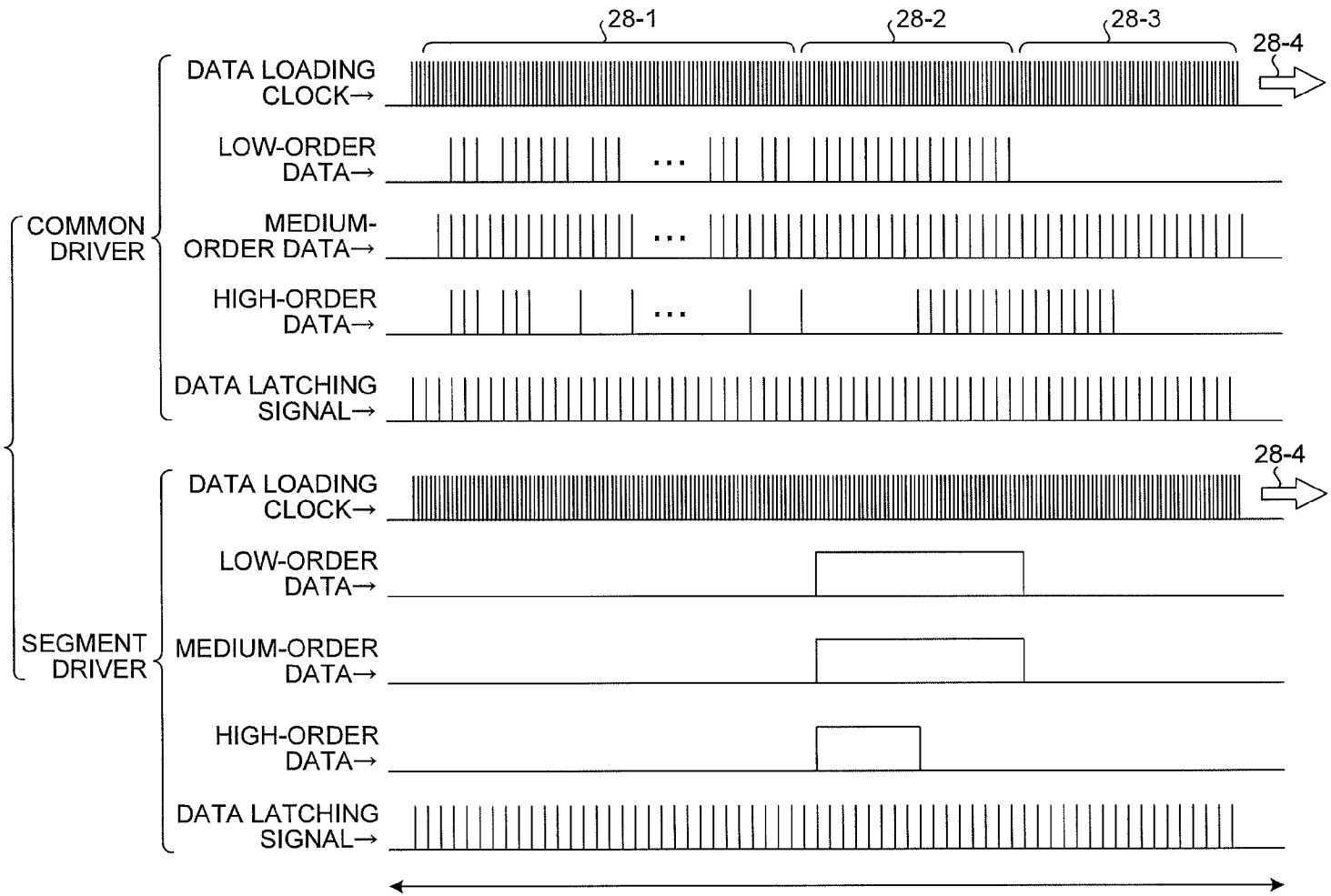
FIG. 28 is a time chart diagram during white drawing of FIG. 26.

FIG. 28 is a time chart diagram during white drawing of FIG. 26. In this case, "28-1" of FIG. 28 indicates a part corresponding to a previous drive line. "28-2" of FIG. 28 indicates a part corresponding to a drawing line. "28-3" of FIG. 28 indicates a part corresponding to a non-selection line. "28-4" of FIG. 28 indicates a direction in which a time advances. Moreover, parts on which vertical lines are illustrated in FIG. 28 indicate that a signal is input into the common driver or the segment driver. For example, parts on which vertical lines are illustrated for low-order, medium-order, and high-order data illustrated in FIG. 28 correspond to "1" of data signals. Moreover, parts on which vertical lines are not illustrated for low-order, medium-order, and high-order data illustrated in FIG. 28 correspond to "0" of data signals.

As illustrated in FIG. 28, the common driver and the segment driver apply voltages according to data that is output from the driver control circuit in accordance with a data loading clock and a data latching signal that are output from the driver control circuit with a constant period.

For example, as illustrated in FIG. 28, when a low order, a medium order, a high order of a data signal input in accordance with a data loading clock and a data latching signal are "0, 1, 0", the common driver determines a voltage corresponding to the data signal with reference to the table illustrated in FIG. 27. Because a voltage corresponding to the data signal is "+15 V", the common driver applies the voltage of "+15 V" to a corresponding line on the band-shaped previous drive lines. Moreover, as illustrated in FIG. 28, when a low order, a medium order, and a high order of a data signal input in accordance with a data loading clock and a data latching signal are "1, 1, 1", the common driver determines a voltage corresponding to the data signal with reference to the table illustrated in FIG. 27. Because a voltage corresponding to the data signal is "−21 V", the common driver applies the voltage of "−21 V" to a corresponding line on the band-shaped previous drive lines.

Moreover, as illustrated in FIG. 28, when a low order, a medium order, a high order of a data signal input in accordance with a data loading clock and a data latching signal are "1, 1, 0", the common driver determines a voltage corresponding to the data signal with reference to the table illustrated in FIG. 27. Because a voltage corresponding to the data signal is "+21 V", the common driver applies the voltage of "+21 V" to a corresponding line on the band-shaped previous drive lines. Moreover, as illustrated in FIG. 28, when a low order, a medium order, a high order of a data signal input in accordance with a data loading clock and a data latching signal are "0, 1, 1", the common driver determines a voltage corresponding to the data signal with reference to the table illustrated in FIG. 27. Because a voltage corresponding to the data signal is "−15 V", the common driver applies the voltage of "−15 V" to a corresponding line on the band-shaped previous drive lines. In this way, during white drawing illustrated at "26-1" of FIG. 26, the common driver applies the voltages of "+15 V", "−21 V", "+21 V", and "−15 V" to the corresponding lines on the band-shaped previous drive lines.

As illustrated in FIG. 28, when a low order, a medium order, a high order of a data signal input in accordance with a data loading clock and a data latching signal are "1, 1, 1", the segment driver determines a voltage corresponding to the data signal with reference to the table illustrated in FIG. 27. Because a voltage corresponding to the data signal is "−21 V", the segment driver applies the voltage of "−21 V" to the drawing line. Moreover, when a low order, a medium order, a high order of a data signal input in accordance with a data loading clock and a data latching signal are "1, 1, 0", the segment driver determines a voltage corresponding to the data signal with reference to the table illustrated in FIG. 27. Because a voltage corresponding to the data signal is "+21 V", the segment driver applies the voltage of "+21 V" to the drawing line. In this way, for example, during white drawing illustrated at "26-1" of FIG. 26, the segment driver applies the voltages of "−21 V" and "+21 V" to the drawing line.

Figure 29:
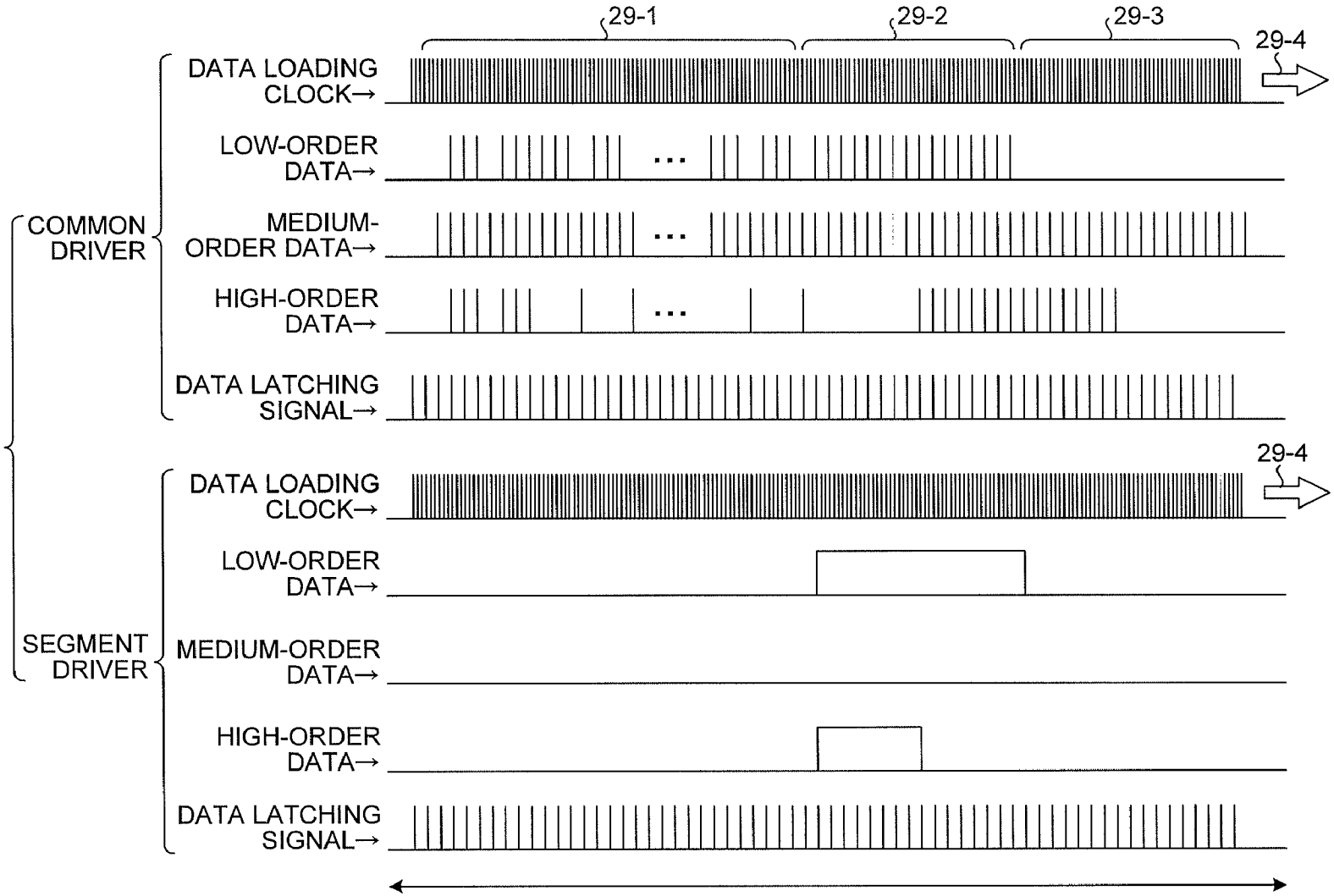
FIG. 29 is a time chart diagram during black drawing of FIG. 26.

FIG. 29 is a time chart diagram during black drawing of FIG. 26. Similarly to "28-1" to "28-3" of FIG. 28, "29-1" of FIG. 29 indicates a part corresponding to a previous drive line, "29-2" of FIG. 29 indicates a part corresponding to a drawing line, and "29-3" of FIG. 29 indicates a part corresponding to a non-selection line. Moreover, similarly to "28-4" of FIG. 28, "29-4" of FIG. 29 indicates a direction in which a time advances. Moreover, similarly to FIG. 28, parts on which vertical lines are illustrated in FIG. 29 indicate that a signal is input into the common driver or the segment driver. For example, parts on which vertical lines are illustrated for low-order, medium-order, and high-order data illustrated in FIG. 29 correspond to "1" of data signals. Moreover, for example, parts on which vertical lines are not illustrated for low-order, medium-order, and high-order data illustrated in FIG. 29 correspond to "0" of data signals.

For example, as illustrated in FIG. 29, when a low order, a medium order, a high order of a data signal input in accordance with a data loading clock and a data latching signal are "0, 1, 0", the common driver determines a voltage corresponding to the data signal with reference to the table illustrated in FIG. 27. Because a voltage corresponding to the data signal is "+15 V", the common driver applies the voltage of "+15 V" to a corresponding line on the band-shaped previous drive lines. Moreover, as illustrated in FIG. 29, when a low order, a medium order, a high order of a data signal input in accordance with a data loading clock and a data latching signal are "1, 1, 1", the common driver determines a voltage corresponding to the data signal with reference to the table illustrated in FIG. 27. Because a voltage corresponding to the data signal is "−21 V", the common driver applies the voltage of "−21 V" to a corresponding line on the band-shaped previous drive lines.

As illustrated in FIG. 29, when a low order, a medium order, a high order of a data signal input in accordance with a data loading clock and a data latching signal are "1, 1, 0", the common driver determines a voltage corresponding to the data signal with reference to the table illustrated in FIG. 27. Because a voltage corresponding to the data signal is "+21 V", the common driver applies the voltage of "+21 V" to a corresponding line on the band-shaped previous drive lines. Moreover, as illustrated in FIG. 29, when a low order, a medium order, a high order of a data signal input in accordance with a data loading clock and a data latching signal are "0, 1, 1", the common driver determines a voltage corresponding to the data signal with reference to the table illustrated in FIG. 27. Because a voltage corresponding to the data signal is "−15 V", the common driver applies the voltage of "−15 V" to a corresponding line on the band-shaped previous drive lines. In this way, during black drawing illustrated at "26-3" of FIG. 26, the common driver applies the voltages of "+15 V", "−21 V", "+21 V", and "−15 V" to the corresponding lines on the band-shaped previous drive lines.

As illustrated in FIG. 29, when a low order, medium order, a high order of a data signal input in accordance with a data loading clock and a data latching signal are "1, 0, 1", the segment driver determines a voltage corresponding to the data signal with reference to the table illustrated in FIG. 27. Because a voltage corresponding to the data signal is "−9 V", the segment driver applies the voltage of "−9 V" to the drawing line. Moreover, when a low order, a medium order, a high order of a data signal input in accordance with a data loading clock and a data latching signal are "1, 0, 0", the segment driver determines a voltage corresponding to the data signal with reference to the table illustrated in FIG. 27. Because a voltage corresponding to the data signal is "+9 V", the segment driver applies the voltage of "+9 V" to the drawing line. In this way, for example, during black drawing illustrated at "26-3" of FIG. 26, the segment driver applies the voltages of "−9 V" and "+9 V" to the drawing line.

(3) Drawing Method During Multi-Tone Expansion

Figure 30:
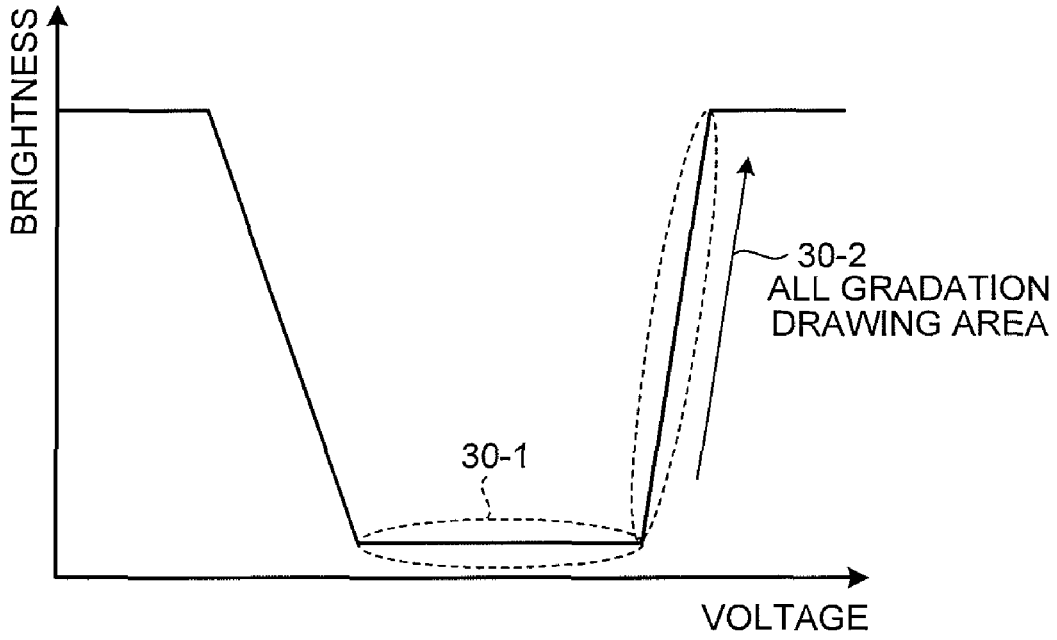
FIG. 30 is a diagram explaining an example of a drawing method during multi-tone expansion according to the fifth embodiment.
Figure 31:
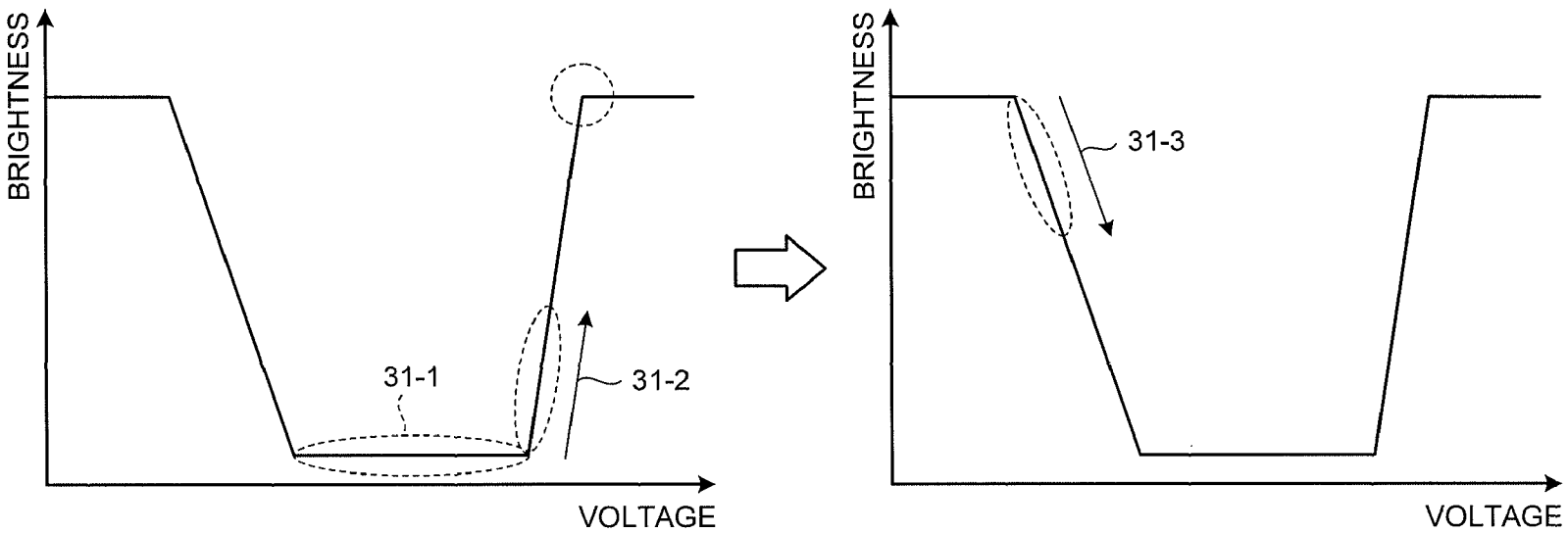
FIG. 31 is a diagram explaining an example of a drawing method during multi-tone expansion according to the fifth embodiment.
Figure 32:
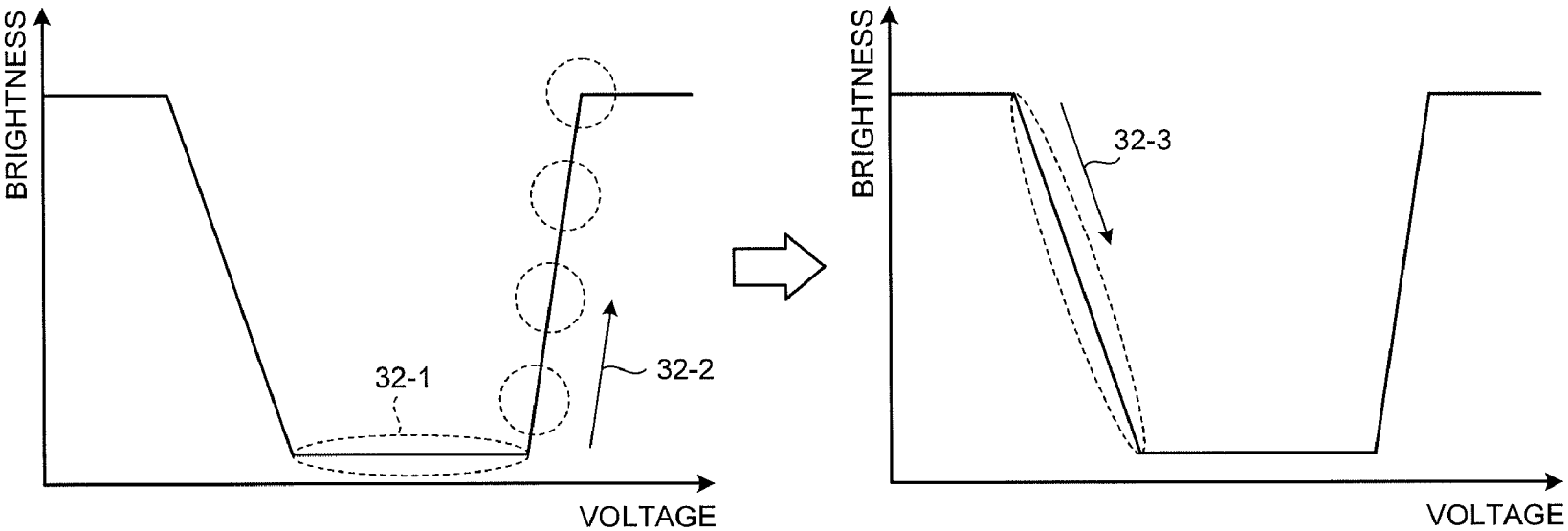
FIG. 32 is a diagram explaining an example of a drawing method during multi-tone expansion according to the fifth embodiment.
Figure 33:
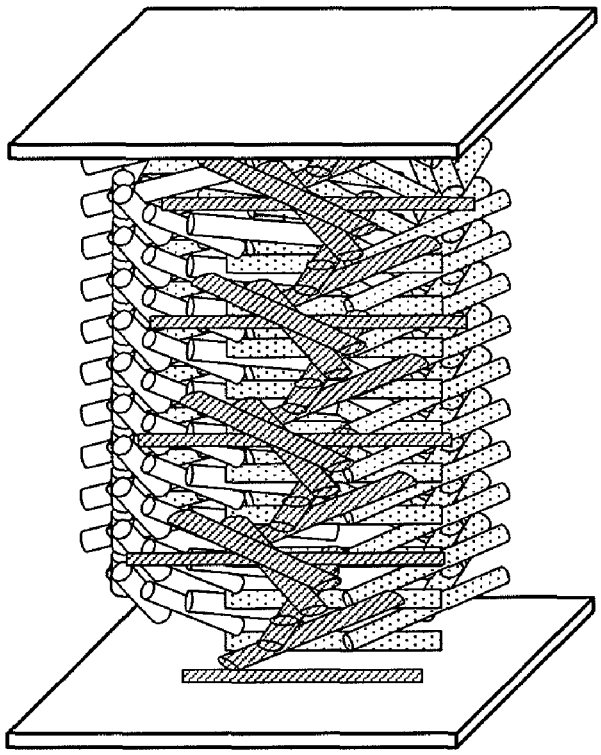
FIG. 33 is a diagram illustrating a molecular structure example of cholesteric liquid crystal.
Figure 34:
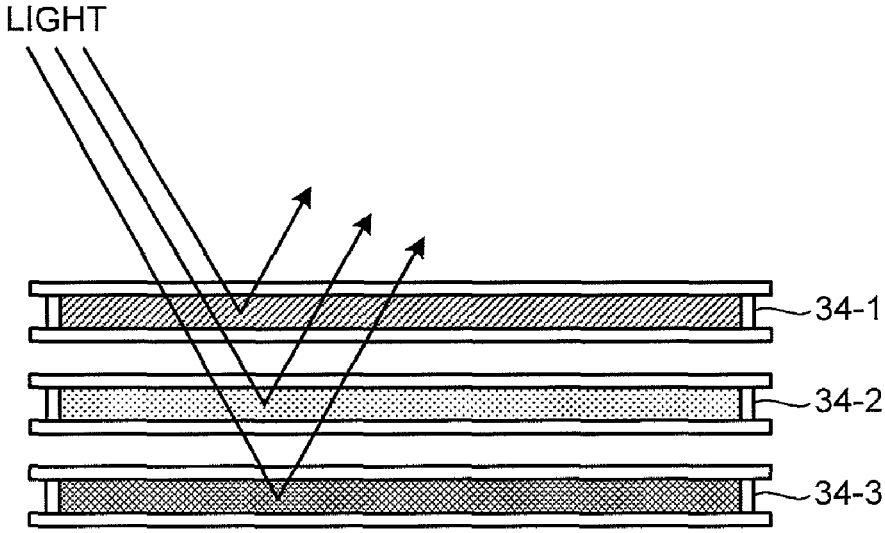
FIG. 34 is a diagram illustrating a structural example of a liquid crystal panel.

When drawing is performed with multiple tones including a half tone like the above (1), it is preferable to use a part in which a response characteristic of liquid crystal is gentle as explained below by using FIGS. 30 to 32. FIGS. 30 to 32 are diagrams explaining an example of a drawing method during multi-tone expansion according to the fifth embodiment.

Vertical axes of FIGS. 30 to 32 indicate the brightness (reflectance) of liquid crystal and horizontal axes of FIGS. 30 to 32 indicate a voltage that is applied to the liquid crystal. Moreover, waveforms illustrated in FIGS. 30 to 32 indicate a response characteristic of liquid crystal. For example, a drawing method illustrated in FIG. 30 means drawing at a position 30-2, which has a steep response characteristic, righter than a position 30-1 at which the molecular structure of liquid crystal is reset to a focal conic state, that is to say, all gradation drawing that is performed by methods explained in the first to fourth embodiments. In the case illustrated in FIG. 30, for example, liquid crystal display of about 4096 color gradation can be performed.

A drawing method illustrated in FIG. 31 has the next two steps. First, at the first step, drawing is performed at a position 31-2, which has a steep response characteristic, righter than a position 31-1 at which the molecular structure of liquid crystal is reset, in other words, drawing is performed with a white, a black, and a half tone by the methods explained in the first to fourth embodiments. Next, at the next step, highlight is drawn at a position 31-3 that has a response characteristic comparatively gentler than that of the position 31-2. Because the granularity of a half-tone liquid crystal display does not stand out comparatively, drawing is performed by the methods explained in the first to fourth embodiments. Because highlight requires high uniformity, drawing is performed at the position 31-3 that has a comparatively gentle response characteristic.

Moreover, a drawing method illustrated in FIG. 32 has the next two steps. First, at the first step, drawing is performed at a position 32-2, which has a steep response characteristic, righter than a position 32-1 at which the molecular structure of liquid crystal is reset, in other words, drawing is performed with 16 gradations over the whole area by the methods explained in the first to fourth embodiments. Next, at the next step, drawing is performed with the remaining 48 gradations at a position 32-3 that has a response characteristic comparatively gentler than that of the position 32-2. Because the granularity of a half-tone liquid crystal display does not stand out comparatively, drawing is performed by the methods explained in the first to fourth embodiments. Because highlight requires high uniformity, drawing is performed at the position 31-3 that has a comparatively gentle response characteristic.

Moreover, at the position 31-3 illustrated in FIG. 31, and the position 32-3 illustrated in FIG. 32, voltage setting is, for example, performed at whole selection "±24 V", half selection "±12 V", and non-selection "±6 V". In this way, highlight is formed in accordance with the accumulated application of a pulse voltage of whole selection and high uniformity is realized in a half-tone display such as 260000 colors.

(4) Device Configuration

For example, the configuration of the liquid crystal display device 100 illustrated in FIG. 6 is a functional concept. Therefore, the configuration is not necessarily constituted physically as illustrated in the drawings. For example, the functions of the driver control circuit 150 illustrated in FIG. 6 may be dispersed functionally or physically into a processing unit that sets a voltage and a processing unit that controls a driver. In this manner, all or a part of the liquid crystal display device 100 can dispersed or integrated functionally or physically in an optional unit in accordance with various types of loads or operating conditions.

(5) Liquid Crystal Driving Method

A liquid crystal driving method applied to the liquid crystal display device 100 when an image is drawn on each line is realized by the embodiments described above by sequentially scanning a plurality of lines included in a liquid crystal display element. Moreover, the liquid crystal driving method includes a voltage application step and a voltage setting step that are below explained.

In the voltage application step, a voltage according to image data of an image is commonly applied from a segment driver to a drawing line, a previous drive line, and a non-selection line, when a plurality of lines included in a liquid crystal display element is sequentially scanned to draw an image. At the same time as this, in the voltage application step, voltages are individually applied from a common driver to the drawing line, the previous drive line, and the non-selection line.

In the voltage setting step, each voltage applied from the segment driver and the common driver is set. At this time, in the voltage setting step, the molecular structure of the liquid crystal display element corresponding to the previous drive line is arranged to a focal conic state regardless of image data by a synthesized voltage of a voltage that is applied from the segment driver and a voltage that is applied from the common driver.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A liquid crystal display device comprising:

a segment driver that commonly applies, when sequentially scanning a plurality of lines included in a liquid crystal display element to draw an image, a voltage according to image data of the image to a drawing line, a previous drive line, and a non-selection line included in the plurality of lines;

a common driver that individually applies voltages to the drawing line, the previous drive line, and the non-selection line; and a voltage setting unit that sets a voltage that is applied from the segment driver and a voltage that is applied from the common driver, in such a manner that a molecular structure of the liquid crystal display element corresponding to the previous drive line becomes a focal conic state regardless of the image data by applying a synthesized voltage of the voltage that is applied from the segment driver and the voltage that is applied from the common driver to the previous drive line.

2. The liquid crystal display device according to claim 1, wherein the voltage setting unit sets the voltage that is applied from the segment driver and the voltage that is applied from the common driver in such a manner that the synthesized voltage of which an effective value is changed in accordance with a change of the image data is applied to the previous drive line.

3. The liquid crystal display device according to claim 2, wherein the voltage setting unit sets the voltage that is applied from the segment driver and the voltage that is applied from the common driver in such a manner that, when a synthesized voltage that is obtained by mixing a first synthesized voltage of which an output voltage is controlled in accordance with a first pulse wave and a second synthesized voltage of which an output voltage is controlled in accordance with a second pulse wave is applied to the previous drive line, a product of a value obtained by exponentiating output levels of voltages included in the first synthesized voltage and a pulse width when the voltage is applied and a product of a value obtained by exponentiating output levels of voltages included in the second synthesized voltage and a pulse width when the voltage is applied are a same.

4. The liquid crystal display device according to claim 2, wherein the voltage setting unit sets a same voltage value as a maximum voltage that is applied from the segment driver and a maximum voltage that is applied from the common driver.

5. The liquid crystal display device according to claim 1, wherein the voltage setting unit sets the voltage that is applied from the segment driver and the voltage that is applied from the common driver in such a manner that voltages having high voltage levels among output levels of the voltages included in the synthesized voltage are continuously applied to the previous drive line.

6. A liquid crystal driving method comprising:

commonly applying, when sequentially scanning a plurality of lines included in a liquid crystal display element to draw an image, a voltage according to image data of the image from a segment driver to a drawing line, a previous drive line, and a non-selection line included in the plurality of lines and individually applying voltages from a common driver to the drawing line, the previous drive line, and the non-selection line; and applying a synthesized voltage of a voltage that is applied from the segment driver and a voltage that is applied from the common driver to the previous drive line in such a manner that a molecular structure of the liquid crystal display element corresponding to the previous drive line becomes a focal conic state regardless of the image data by applying the synthesized voltage of the voltage that is applied from the segment driver and the voltage that is applied from the common driver to the previous drive line.

7. The liquid crystal driving method according to claim 6, wherein the applying a synthesized voltage includes applying the voltages from the segment driver and the common driver in such a manner that the synthesized voltage of which an effective value is changed in accordance with a change of the image data is applied to the previous drive line.

8. The liquid crystal driving method according to claim 7, wherein the applying a synthesized voltage includes applying the voltages from the segment driver and the common driver in such a manner that, when a synthesized voltage that is obtained by mixing a first synthesized voltage of which an output voltage is controlled in accordance with a first pulse wave and a second synthesized voltage of which an output voltage is controlled in accordance with a second pulse wave is applied to the previous drive line, a product of a value obtained by exponentiating output levels of voltages included in the first synthesized voltage and a pulse width when the voltage is applied and a product of a value obtained by exponentiating output levels of voltages included in the second synthesized voltage and a pulse width when the voltage is applied are a same.

9. The liquid crystal driving method according to claim 7, wherein a maximum voltage that is applied from the segment driver and a maximum voltage that is applied from the common driver are a same voltage value.

10. The liquid crystal driving method according to claim 6, wherein the applying a synthesized voltage includes applying the voltages from the segment driver and the common driver in such a manner that voltages having high voltage levels among output levels of the voltages included in the synthesized voltage are continuously applied to the previous drive line.

* * * * *